US007138222B2

(12) United States Patent
Haraguchi et al.

(10) Patent No.: US 7,138,222 B2
(45) Date of Patent: Nov. 21, 2006

(54) SILVER HALIDE COLOR PHOTOGRAPHIC PHOTOSENSITIVE MATERIAL

(75) Inventors: Nobuyuki Haraguchi, Kanagawa (JP); Yasushi Miyamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/090,987

(22) Filed: Mar. 28, 2005

(65) Prior Publication Data

US 2005/0214698 A1 Sep. 29, 2005

(30) Foreign Application Priority Data

Mar. 26, 2004 (JP) ..... 2004-093621

(51) Int. Cl.

| | |
|---|---|
| ***G03C 1/46*** | (2006.01) |
| ***G03C 1/06*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/506; 430/502; 430/503; 430/567; 430/599; 430/600; 430/603; 430/607; 430/611; 430/613; 430/379

(58) Field of Classification Search ..... 430/502, 430/503, 506, 567, 599, 600, 603, 607, 611, 430/613, 379

See application file for complete search history.

(56) References Cited

U.S. PATENT DOCUMENTS

| | | | |
|---|---|---|---|
| 4,463,087 | A | 7/1984 | Maskasky |
| 4,471,050 | A | 9/1984 | Maskasky |
| 6,720,134 | B1 | 4/2004 | Miyamoto et al. |

FOREIGN PATENT DOCUMENTS

| | | | |
|---|---|---|---|
| JP | 59-133540 | A | 7/1984 |
| JP | 9-222684 | A | 8/1997 |
| JP | 2003-15245 | A | 1/2003 |

*Primary Examiner*—Geraldine Letscher
(74) *Attorney, Agent, or Firm*—Sughrue Mion, PLLC

(57) ABSTRACT

The present invention provides a silver halide color photographic photosensitive material that includes coupler-containing sensitive emulsion layer units on a support. Each of the photosensitive emulsion layer units are constituted of at least two photosensitive emulsion layers having sensitivities which are different from each other. An emulsion layer of the highest sensitivity among the at least two photosensitive emulsion layers contains at least one silver halide emulsion in which tabular silver halide grains with an average aspect ratio of 3 or more substantially including dislocation lines account for 50% or more of the total projected areas. Photosensitive emulsion layers other than the emulsion layer of the highest sensitivity consist of a silver halide emulsion containing silver halide grains that account for 70% or more of the total projected areas and include host grains that satisfy a specific aspect ratio condition and epitaxially joined protrusions.

13 Claims, No Drawings

SILVER HALIDE COLOR PHOTOGRAPHIC PHOTOSENSITIVE MATERIAL

CROSS-REFERENCE TO RELATED APPLICATION

This application claims priority under 35 USC 119 from Japanese Patent Application No. 2004-093621, the disclosure of which is incorporated by reference herein.

FIELD OF INVENTION

The present invention relates to a silver halide color photographic photosensitive material having high sensitivity and has excellent latent image storability.

DESCRIPTION OF THE RELATED ART

It is generally known that a tabular silver halide grain (hereinafter, referred to as a "tabular grain") is used in order to obtain a silver halide photographic photosensitive material having high sensitivity and excellent graininess and sharpness. Further, it is also generally well known that performance of the tabular grain is enhanced by introducing crystal lattice distortion referred to as a "dislocation line". Furthermore, as another method for sensitizing the tabular grain, a sensitization method using an epitaxial junction has been disclosed (refer to, for example, Japanese Patent Application Laid-Open (JP-A) No. 59-133540).

Regarding techniques for introducing the dislocation line, operation for introducing the dislocation line induces a problem of impairing anisotropic growth property of the tabular grain in a horizontal direction. Since the tendency becomes especially pronounced in a tabular grain of small size having a large volume specific surface dimension, it is difficult to produce a photographic photosensitive material having high sensitivity and excellent graininess only with an emulsion containing tabular grains having enhanced performance by introducing the dislocation line. On the other hand, although an epitaxial emulsion is advantageous in that there is no restriction caused by the dislocation line, there are problems in performance stability and the like. As a technique for improving stability and enhancing photographic properties such as sensitivity of the epitaxial emulsion, a technique has been further disclosed (refer to JP-A No. 2003-15245) in which silver halide with a relatively high silver bromide content is epitaxially joined to a host tabular grain with a relatively high silver bromide content and further a shallow electron trap zone is introduced thereto.

However, it has been revealed that the disclosed epitaxial emulsion has such problems that a tabular grain emulsion with a large size and high sensitivity cannot be prepared, and that the definition of the epitaxial silver amount to the host grain is inappropriate.

In addition to the above, a method has been discussed for preparing a photosensitive material employing a tabular grain emulsion which substantially has a dislocation line(s) for the highest sensitivity layer, and employing an emulsion containing a tabular grain of a small size which substantially has no dislocation line for a low sensitivity layer (refer to JP-A No. 9-222684). Specifically, in the low sensitivity layer, performance of the tabular grain which substantially has no dislocation line is improved by converting it into a so-called "internal latent image type", in which the grain after chemical sensitization is subjected to shell formation, to accomplish a thin plate of a tabular grain. However, actually, it is difficult to compensate performance degradation occurring in the case where the dislocation line is not introduced with formation of the internal latent image and, since no other means for improving performance is described, it has become clear that a method for further improving performance is necessary.

SUMMARY OF THE INVENTION

The present invention provides a silver halide color photographic photosensitive material having high sensitivity and excellent graininess and also in latent image storability.

Namely, the invention provides a silver halide color photographic photosensitive material comprising: a blue light-sensitive emulsion layer unit containing a yellow-forming color coupler; a green light-sensitive emulsion layer unit containing a magenta-forming color coupler; and a red light-sensitive emulsion layer unit containing a cyan-forming color coupler on a support, wherein each of the blue light-sensitive emulsion layer unit, the green light-sensitive emulsion layer unit, and the red light-sensitive emulsion layer unit comprises at least two photosensitive emulsion layers having sensitivities which are different from each other; an emulsion layer of the highest sensitivity among the at least two photosensitive emulsion layers comprises at least one kind of silver halide emulsion in which tabular silver halide grains having an average aspect ratio of 3 or more and substantially having dislocation lines account for 50% or more of the total projected areas; and photosensitive emulsion layers other than the emulsion layer of the highest sensitivity consist of a silver halide emulsion containing silver halide grains that account for 70% or more of the total projected areas satisfy a requirement (a): the grain is constituted of a tabular silver halide host grain having two principal planes parallel to each other and an aspect ratio of 2 or more, and of a protrusion of silver halide epitaxially joined to the host grain surface.

DETAILED DESCRIPTION OF THE INVENTION

Hereinafter, the invention will be described in detail.

The tabular silver halide emulsion that contains silver halide grains which substantially have dislocation lines used in the invention (hereinafter, referred to as a "dislocation tabular grain emulsion") contains the tabular silver halide grains, each of which preferably has an aspect ratio of 3 or more to 100 or less and substantially has dislocation lines (hereinafter, referred to as a "dislocation tabular grain"). Here, the tabular silver halide grain is a generic term for silver halide grains including one twin crystal plane or two or more parallel twin crystal planes. The twin crystal plane means a (111) plane when ions at all the lattice points are in a mirror image relationship on both sides of the (111) plane. The tabular grain is constituted of two principal planes parallel to each other and side planes connecting these principal planes. When viewing the tabular grain from above against the principal plane, the principal plane has a triangular figure, a hexagonal figure, or a circular figure constituted of a rounded triangle or hexagon. The grain of the triangular figure, hexagonal figure and circular figure have principal planes parallel to each other in triangle, hexagon and circle, respectively.

An aspect ratio of a tabular silver halide grain means a value obtained by dividing the grain diameter by the thickness. Measurement of a thickness of a grain can be carried out easily by depositing a metal to the grain and a latex for reference from an oblique direction, measuring the length of shadows thereof on an electron microscopic photograph and carrying out calculation while referring to the shadow length of the latex.

The grain diameter in the invention means a diameter of a circle having an area equal to a projected area of the parallel principal planes of the grain. The projected area of the grain can be obtained by measuring an area on the electron microscopic photograph and correcting the photographing magnification. Preference is given to from 0.3 to 5.0 μm for the diameter, and from 0.05 to 0.5 μm for the thickness of the tabular grain, respectively.

In the dislocation tabular grain for use in the invention, the sum of the projected areas thereof preferably accounts for 50% or more, and particularly preferably 80% or more, to the sum of the projected areas of the total silver halide grains in the emulsion. In addition, preferably the aspect ratio of the tabular grain occupying such certain areas is from 3 to less than 100. More preferably, it is from 4 to less than 30, and further more preferably from 5 to less than 15.

Further, sometimes use of monodisperse tabular grains gives a more preferable result. The structure and manufacturing method of monodisperse tabular grains are as described in JP-A No. 63-151618, for example. The figure thereof will be described simply below. The silver halide grains are occupied, by 70% or more of the total projected areas, by tabular silver halides which are in hexagons having a ratio of 2 or less between the longest edge and the shortest edge in the principal plane and have two parallel planes as external surfaces, and further have monodisperse property with 20% or less of the variation coefficient for distribution of grain sizes of the hexagonal tabular silver halide grains (a value obtained by dividing variations (standard deviation) of the grain sizes represented by the circle-converted diameter of the projected areas by the average grain size).

Next, description will be given about a dislocation line(s) of a dislocation tabular grain.

The dislocation line of a tabular grain can be observed by a direct method using a transmission electron microscope at low temperatures as described in, for example, J. F. Hamilton, Phot. Sci. Eng., 11, 57 (1967) and T. Shiozawa, J. Soc. Phot. Sci. Japan. 35, 213 (1972). That is, silver halide grains, which have been taken out of an emulsion with care so as not to be applied a pressure that may generate a dislocation line on the grain, are placed on a mesh for electron microscopic observation, followed by observation with a transmission method in a state of cooling the sample for the purpose of preventing damages (printout, etc.) due to an electron beam. In this case, since a larger thickness of the grain results in more difficulty in transmission of the electron beam, use of a high-pressure type electron microscope (200 kV or more for a grain with a thickness of 0.25 μm) will realize a sharper observation. Use of the photograph of the grains thus obtained can give position of the dislocation line seen from the direction perpendicular to the principal plane for respective grains.

As for the position of the dislocation line of the dislocation tabular grain for use in the invention, it generates at a distance of x % of length, measured from the center to the edge, to the edge in the major axis direction of the tabular grain. The value of x is preferably $10 \leqq x < 100$, more preferably $30 \leqq x < 98$, and further preferably $50 \leqq x < 95$. In this case, a figure formed by connecting the positions from where the dislocation lines start is similar to the figure of the grain, but is not completely similar and sometimes may twist. Direction of the dislocation line is approximately the direction from the center to the edge, but the line serpentines often.

As for the number of dislocation lines of the dislocation tabular grain for use in the invention, presence of grains containing 10 or more dislocation lines by 50% (number) or more is preferable. Presence of grains containing 10 or more dislocation lines by 80% (number) or more is more preferable, and presence of grains containing 20 or more dislocation lines by 80% (number) or more is particularly preferable.

Dislocation of the tabular grain for use in the invention is introduced by preparing a high-iodine phase within the grain. The high-iodine phase means a silver halide solid solution containing iodine. As a silver halide in this case, silver iodide, silver iodobromide or silver chloroiodobromide is preferable, silver iodide or silver iodobromide is more preferable, and silver iodide is particularly preferable.

The amount of silver halide forming the high-iodine phase is 30 mol % or less, and more preferably 10 mol % or less of the silver amount of the whole grains in terms of the silver amount.

A phase allowed to grow on the outer side of the high-iodine phase is required to contain iodine by a lower content than that of the high-iodine phase. The iodine content of 0 to 12 mol % is preferable, 0 to 6 mol % is more preferable, and 0 to 3 mol % is most preferable.

As a preferable method for forming the high-iodine phase, there is such a method as forming it by adding an emulsion containing silver iodobromide or silver iodide fine grains. Use of fine grains having been prepared in advance is possible, and use of fine grains just after preparation is more preferable. When fine grains just after preparation are used, additional use of an external mixing apparatus, which is described in JP-A No. 10-043570 and to be explained in detail later in the explanation of growth process of the tabular grain, is effective.

Here, first, a case where a fine grain prepared in advance is used will be explained. In this case, there is a method in which the fine grain prepared in advance is added and matured to dissolve. As a more preferable method, there is a method in which a silver iodide fine grain emulsion is added and then an aqueous silver nitrate solution, or an aqueous silver nitrate solution and an aqueous halogen solution are added. In this case, dissolution of the silver iodide fine grain emulsion is accelerated by adding the aqueous silver nitrate solution. Preference is given to rapid addition of the silver iodide fine grain emulsion.

Rapid addition of the silver iodide fine grain emulsion means preferably adding the silver iodide fine grain emulsion within 10 minutes. More preferably, it means adding the same within 7 minutes. The condition may change depending on temperature, pBr, pH, kind or concentration of a protective colloid agent such as gelatin, presence or absence, kind or concentration of a silver halide solvent. However, a shorter period is preferable as described above. During the addition, no substantial addition of an aqueous solution of silver salt such as silver nitrate is preferable. Temperature of the system during the addition is from 40° C. to 90° C. preferably, and particularly preferably from 50° C. to 80° C.

Silver iodide contained in the silver iodide fine grain emulsion may be substantial silver iodide, and may contain silver bromide and/or silver chloride as long as they can form a mixed crystal. Preference is given to silver iodide by 100%. Silver iodide may have a crystal structure of β shape, γ shape and, as described in U.S. Pat. No. 4,672,026, a shape or a structure similar to α shape. Although there is no limitation particularly on the crystal structure in the invention, a mixture of β shape and γ shape, and more preferably β shape is used. As for the silver iodide fine grain emulsion, one having been subjected to a usual water washing process is preferably used. The silver iodide fine grain emulsion can be formed easily by a method described in U.S. Pat. No. 4,672,026 etc. Preference is given to a double-jet addition method of an aqueous silver salt solution and an aqueous iodide solution, in which grain formation is carried out while keeping a pI value at grain formation constant. Here, the pI is a logarithm of reciprocal number of iodine ion concentration in the system. Although there is no particular limitation on temperature, pI, pH, kind and concentration of a protective colloid agent such as gelatin, presence or absence, kind and concentration of a solvent, and the like, a size of the grain of 0.1 μm or less, and more preferably 0.07 μm or less is advantageous to the invention. Although complete identification of the grain figure is difficult because of fine grains, the coefficient of variation of the grain size distribution is preferably 25% or less. In particular, 20% or less gives a significant effect of the invention.

Here, sizes and distribution of the sizes of silver iodide fine grains in the emulsion is obtained by placing the silver iodide fine grains on a mesh for electron microscope observation and observing the same directly with a transmission method, instead of a carbon replica method. This is because the grain has a small size, and observation utilizing a carbon replica method makes error of measurement large. The grain size is defined as a diameter of a circle having a projected area equal to that of the observed grain. The distribution of grain sizes is also obtained by using the diameter of the circle having the equal projected area. The most effective silver iodide fine grain in the invention has a grain size from 0.02 μm to 0.06 μm, and a coefficient of variation of the grain size distribution of 18% or less.

After the aforementioned grain formation, the silver iodide fine grain emulsion is subjected, preferably, to usual water washing, adjustment of pH, pI and concentration of a protective colloid agent such as gelatin as described in U.S. Pat. No. 2,614,929, and to adjustment of concentration of the contained silver iodide. Preferable pH is from 5 to 7. As for the pI value, a pI value set so as to make solubility of the silver iodide minimum or a value higher than that is preferable. As for the protective colloid agent, a usual gelatin with an average molecular weight of around 100,000 is preferably used. A low molecular weight gelatin with an average molecular weight of 20,000 or less is also preferably used. Further, sometimes use of a mixture of aforementioned gelatins having different molecular weights gives an advantageous result. The amount of the gelatin is preferably from 10 g to 100 g, and more preferably from 20 g to 80 g per 1 kg of the emulsion. The amount of silver in terms of silver atom is preferably from 10 g to 100 g, and more preferably from 20 g to 80 g per 1 kg of the emulsion. The silver iodide fine grain emulsion is usually added after having been dissolved in advance but, during the addition, stirring efficiency of the system must be enhanced sufficiently. Preferably, a stirring rotation number is set to a raised value compared with usual cases. Addition of an antifoaming agent is effective for preventing generation of foam during stirring. Specifically, the antifoaming agent described in the example etc. of U.S. Pat. No. 5,275,929 is used.

As for silver iodide content distribution among grains, the silver halide grain according to the invention preferably has a coefficient of variation of 20% or less, more preferably 15% or less, and particularly preferably 10% or less. The coefficient of variation more than 20% leads to disadvantageous results such as a non-hard tone and a larger decrease in sensitivity when pressure is added. The silver iodide content of respective grains can be measured by analyzing the composition of respective grains using an X-ray microanalyzer. The coefficient of variation of silver iodide content distribution among grains is a value defined according to the relational formula, CV=(standard deviation/average silver iodide content)×100, while using the standard deviation and the average silver iodide content of silver iodide contents obtained by measuring the silver iodide content for at least 100, more preferably 200 or more, and particularly preferably 300 or more grains in the emulsion. Measurement of silver iodide content for respective grains is described in, for example, European Patent No. 147,868. Between silver iodide content Yi (mol %) and an equivalent-sphere diameter Xi (μm) of respective grains, correlation may be present or absent, and absence of the correlation is desirable.

Next, explanation will be given on about an emulsion containing an epitaxial tabular silver halide grains which is other than the emulsion containing the tabular silver halide grains which have a substantial dislocation line and which is used for the invention (hereinafter, referred to as an "epi-emulsion"). The silver halide epi-emulsion according to the invention is characterized in that silver halide grains constituted of tabular silver halide host grains having two principal planes parallel to each other and an aspect ratio of two or more (hereinafter, referred to as a "host tabular grain" or "host grain"), and a protrusion of silver halide epitaxially joined to the surface of the host grain (hereinafter, referred to as a "silver halide protrusion" or "protrusion") account for 70% or more of the total projected area. More preferably the silver halide grain accounts for 80% or more, and most preferably 90% or more of the total projected areas. Here, the protrusion means a part which is raised relative to the host grain, and can be confirmed with an electron microscopic observation.

The host tabular grain in the invention is constituted of two principal planes parallel to each other and side planes connecting the principal planes. The figure of the principal plane may be selected from any of polygons enclosed with straight lines, a figure enclosed with a circle, ellipsoid or an infinite curved line(s), and a figure enclosed with a combination of a straight line(s) and a curved line(s), and having at least one tip is preferable. Further, one of a triangle having three tips, a quadrangle having four tips, a pentagon having five tips or hexagon having six tips, or a combination thereof is more preferable. Here, the tip means a non-rounded angle formed by adjacent two edges. When an angle is rounded, it means a point dividing the rounded curved portion equally.

The principal plane of the host tabular grain in the invention may be of any kind of crystal structure. That is, the crystal structure of the principal plane may be a (111) plane, (100) plane or (110) plane, or a further higher plane, and the most preferable embodiment is a tabular grain with the principal plane of a (111) or (100) plane. In the case of a tabular grain with a (111) plane as the principal plane, a mode, in which grains with the principal plane of a figure of a hexagon having six tips account for 70% or more of the total projected areas, is preferable. On the other hand, in the case of a tabular grain with a (100) plane as the principal plane, a mode, in which grains with the principal plane of a figure of a quadrangle having four tips account for 70% or more of the total projected areas, is preferable.

The host tabular grain in the invention is characterized in that an aspect ratio obtained by dividing the equivalent-circle diameter of the grain by the grain thickness is 2 or more. The aspect ratio is preferably from 5 to 200, more preferably 10 to 200, and most preferably 15 to 200. Here, the equivalent-circle diameter of the grain is a diameter of a circle having an area equal to the projected area of the principal plane.

The equivalent-circle diameter of the host tabular grain can be obtained, for example, by taking a transmission electron microscopic photograph according to a replica method, obtaining a projected area of the respective grains by correcting the photographing magnification, and converting the same to the equivalent-circle diameter. Although grain thickness cannot be calculated simply, in some cases, from the length of the shadow of the replica due to epitaxial precipitation, it can be calculated by measuring the length of the shadow of the replica before the epitaxial precipitation. Or, even after the epitaxial precipitation, it can be obtained easily by cutting a sample coated with the emulsion, and by taking an electron microscopic photograph of the section of the same.

The equivalent-circle diameter of the host tabular grain in the invention is preferably from 0.5 to 10.0 μm, and more preferably 0.7 to 10.0 μm. The thickness is preferably from 0.02 μm to 0.5 μm, more preferably 0.02 to 0.2 μm, and most preferably 0.03 to 0.15 μm.

In the host tabular grain in the invention, the coefficient of variation for equivalent-circle diameters among the grains is 40% or less preferably, 30% or less more preferably, and 25% or less particularly preferably. Here, the coefficient of variation for equivalent-circle diameters among the grains means a value obtained by dividing the standard deviation of distribution of respective equivalent-circle diameters of the grains by the average equivalent-circle diameter, and then multiplying by 100.

In the invention, the silver halide protrusion is formed at an arbitrary position on the surface of the host tabular grain through an epitaxial junction. A preferable formation position is on the principal plane, or at the tip portion, or on the edge other than the tip portion of the host tabular grain. The most preferable formation position is the tip portion. Here, the tip portion means a portion within a circle having a diameter of one third of a shorter edge between two edges adjacent to the tip, while viewing the tabular grain from a direction perpendicular to the principal plane. Specifically, a mode, in which silver halide grains including the protrusion at all the tips on the principal plane of the host tabular grain account for 70% or more of the total projected areas, is preferable; a mode, in which they account for 80% or more of the total projected areas, is more preferable; and a mode, in which they account for 90% or more of the total projected areas, is most preferable.

The silver amount of the silver halide protrusion according to the invention is characterized in that the percentage thereof is 20% or less relative to the silver amount of the host tabular grain. The percentage of the silver amount is preferably from 2% to 17%, and more preferably from 4% to 15%. If the percentage of the silver amount is too small, reproducibility of the epitaxial formation becomes poor; if the percentage is too large, this leads to problems such as decrease in sensitivity and degradation of graininess. The percentage of the silver halide protrusion on the grain surface is preferably 50% or less, and more preferably 20% or less of the host tabular grain surface.

In the silver halide protrusion according to the invention, inclusion of a pseudo-halide is preferable. As described in JP-A No. 7-72569, the term "pseudo-halide" means a group of compounds known as compounds having properties near to those of halide (that is, those capable of providing a monovalent and sufficiently electrically negative anion group which represents at least the same positive Hammett's ▯ value as the halide, for example $CN^-$, $OCN^-$, $SCN^-$, $SeCN^-$, $TeCN^-$, $N_3^-$, $C(CN)_3^-$, and $CH^-$). The content of the pseudo-alide in the protrusion portion is preferably from 0.01 to 10 mol %, and more preferably from 0.1 to 7 mol % relative to the silver amount contained in the protrusion.

In the silver halide grain according to the invention, both of the host grain and protrusion have a halogen composition of pure silver bromide, or silver iodobromide, silver chlorobromide or silver chloroiodobromide with a silver bromide content of 70 mol % or more. A content lower than 70 mol % generates a negative effect such as increase in fog raise after storage. A silver bromide content of 80 mol % or more is more preferable, and 90 mol % or more is most preferable.

In the silver halide grain according to the invention, an average silver iodide content for each of all the grains is preferably 20 mol % or less, more preferably 15 mol % or less, and most preferably 10 mol % or less. A silver iodide content of more than 20 mol % cannot give a sufficiently high sensitivity. In addition, a mode, in which the average silver iodide content of the protrusion is lower than the average silver iodide content of an 8%-outer shell (relative to the host grain silver amount) of the host grain, is preferable. Here, the 8%-outer shell of the host grain means a region in which the silver amount in a layer-shaped region in the direction from the surface of the host grain to the grain center accounts for 8% relative to the total silver amount of the host grain.

In the silver halide grain according to the invention, the silver chloride content of both of the host grain and protrusion is preferably 8 mol % or less, more preferably 4 mol % or less and, further, most preferably 1 mol % or less.

In the silver halide grain according to the invention, an inter-grain distribution of silver iodide contents is preferably a mono dispersion. Specifically, a preferable embodiment is that, in a case where the average silver iodide content of the whole grains is defined as I mol %, silver halide grains with a silver iodide content from 0.6 I to 1.4 I account for 70% or more of the total projected areas. Furthermore, a mode, in which silver halide grains with a silver iodide content in a range from 0.7 I to 1.3 I account for 70% or more of the total projected areas, is preferable.

In the silver halide grain according to the invention, the host grain or protrusion, or both of the host grain and protrusion may contain silver salts other than silver chloride, silver bromide and silver iodide such as silver rhodanate, silver selenocyanate, silver tellurocyanate, silver sulfide, silver selenide, silver telluride, silver carbonate, silver phosphate and organic acid silver as a part of the silver halide. Or the emulsion according to the invention may contain silver salts other than silver halide as a separate grain.

Next, the grain structure of the dislocation tabular grain and host grain for use in the invention will be described.

The dislocation tabular grain and host grain for use in the invention may have a multiple structure of a double or more structure relating to a halogen composition distribution in the grain. For example, it may have a fivefold construction. Here, the structure means that there exists a structure relating to the intra-grain distribution of silver iodide, and that the silver iodide content differs among respective structures by 1 mol % or more. The structure relating to the intra-grain distribution of silver iodide can be obtained basically by calculation from a prescription value of a preparation process for the grain. As for variation of the silver iodide content at an interface of respective structures, there may be a case in which the variation is rapid and a case in which the variation is smooth. In order to confirm these, although a measurement accuracy in analysis must be taken into consideration, usually, an EPMA method (Electron Probe Micro Analyzer method) is effective. By preparing a sample in which emulsion grains are dispersed so as not to contact with each other, and analyzing an X-ray being radiated when the sample is irradiated with electron beams, elemental analysis can be carried out for an ultra small region having been irradiated with the electron beams. Preferably, in order to prevent damage of the sample due to the electron beams, the measurement is carried out under a condition cooled to low temperatures. According to the same manner, an intra-grain silver iodide distribution in the case where the tabular grain is viewed from the direction perpendicular to the principal plane can be analyzed. And, further, use of a sample obtained by solidifying the sample and cutting the same with a microtome to an ultra thin chip also makes it possible to analyze an intra-grain silver iodide distribution at a section of the tabular grain.

Next, a method for sensitizing the dislocation tabular grain emulsion and epi-emulsion will be explained. In the invention, a method such as sulfur sensitization, selenium sensitization, tellurium sensitization or reduction sensitization, or a combination of theses with a gold sensitization method or a sensitization method using noble metal other than gold compound, can be applied.

Another chemical sensitization method that can be used together preferably in the invention can be carried out by using an active gelatin, as described in T. H. James, The Theory of the Photographic Process, 4th ed, Macmillan, 1977) pp 67–76. Further, it can be carried out by using sulfur, selenium, tellurium, gold, platinum, palladium or iridium, or a multiple combination of these sensitizers at pAg from 5 to 10, pH from 5 to 8 and temperature from 30 to 80° C., as described in Research Disclosure, Vol. 120, April 1974, 12008; Research Disclosure, Vol. 34, June 1975, 13452; U.S. Pat. Nos. 2,642,361, 3,297,446, 3,772,031, 3,857,711, 3,901,714, 4,266,018 and 3,904,415; and Great Britain patent (GBP) No. 1,315,755. In a noble metal sensitization, salt of noble metal such as gold, platinum, palladium or iridium and, among them, gold sensitization, palladium sensitization, or simultaneous use of both of them are preferable in particular. In the case of gold sensitization, publicly known compounds such as aurichloric acid, potassium chloroaurate, potassium auricthiocyanate, gold sulfide and gold selenide, and mesoionic gold compound described in U.S. Pat. No. 5,220,030 and azole gold compound described in U.S. Pat. No. 5,049,484 can be used. Palladium compound means bivalent salt and tetravalent salt of palladium. Preferable palladium compound is represented by $R_2PdX_6$ or $R_2PdX_4$, where R represents a hydrogen atom, alkali metal atom or ammonium group. X represents a halogen atom, examples thereof include a chlorine atom, a bromine atom and an iodine atom. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. The gold compound and palladium compound are preferably used in combination with thiocyanate or selenocyanate.

As for a sulfur sensitization agent, hypo, thiourea-series compound, rhodanine-series compound and sulfur-containing compounds described in U.S. Pat. Nos. 3,857,711, 4,266,018 and 4,054,457 can be used. Chemical sensitization under the presence of a so-called chemical sensitization auxiliary agent is also possible. As a useful chemical sensitization auxiliary agent, a compound that is known as one capable of inhibiting fog in a chemical sensitization process and increasing sensitivity is used, including azaindene, azapyridazine and azapyrimidine. Examples of a chemical sensitization auxiliary agent modifier are described in U.S. Pat. Nos. 2,131,038, 3,411,914, 3,554,757, JP-A No. 58-126526, and aforementioned Daffin, "Photographic Emulsion Chemistry" pp 138–143. Amount of a sulfur sensitization agent for use in the invention is preferably from $1\times10^{-4}$ to $1\times10^{-7}$ mol, and more preferably from $1\times10^{-5}$ to $5\times10^{-7}$ mol per 1 mol of silver halide.

Among these sulfur sensitization agents, a thiourea-series sulfur sensitization agent can be used. As a thiourea-series sulfur sensitization agent, in addition to thiourea, a compound having a substituent at N and N' sites can be used. Examples of a substituent at N and N' sites include an acetyl group, alkyl group, aryl group, heterocycle group, and a group having a further substituent group on these groups. An alkyl group is preferable. Preferable number of the substituent at N and N' sites is any of from 1 to 3. In the case where number of the substituent is 2 or 3, each of the substituents may be the same to or different from one another.

Specific examples of compound will be given below as thiourea-series sulfur sensitizer, however, the sulfur sensitizer for use in the invention is not limited to these compounds.

S-1

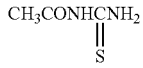

S-2

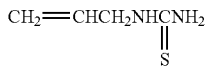

S-3

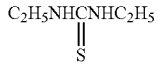

S-4

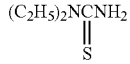

S-5

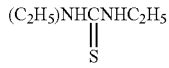

S-6

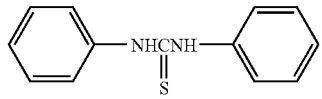

S-7

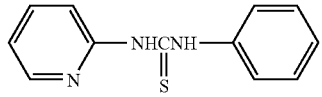

S-8

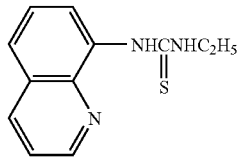

S-9

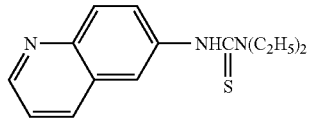

-continued
S-10
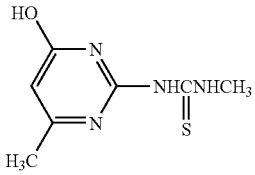
S-11
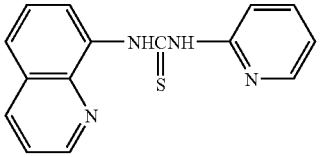
S-12
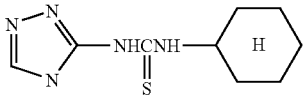
S-13
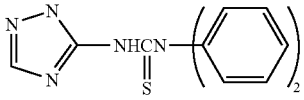
S-14
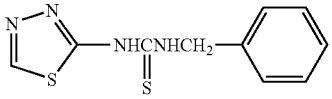
S-15
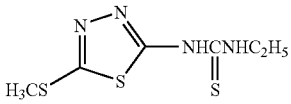
S-16
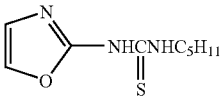
S-17
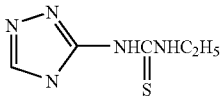
S-18
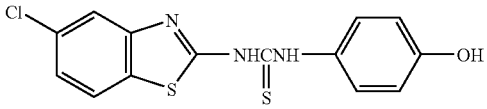
S-19
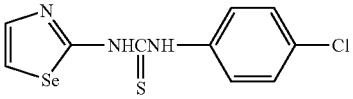
S-20
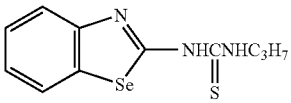
S-21
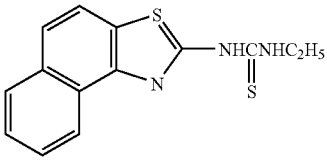
-continued
S-22
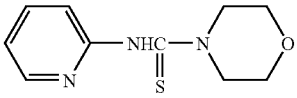
S-23
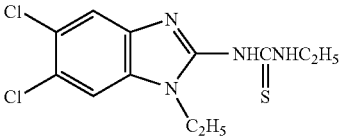
S-24
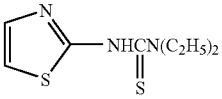
S-25
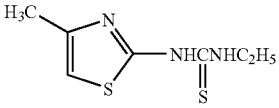
S-26
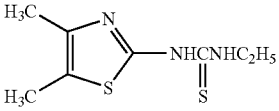
S-27
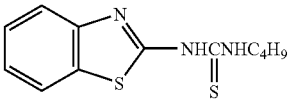
S-28
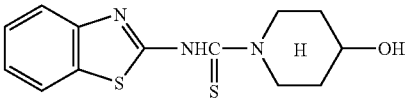
S-29
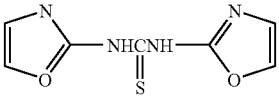
S-30
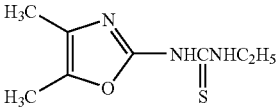
S-31
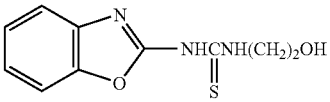
S-32
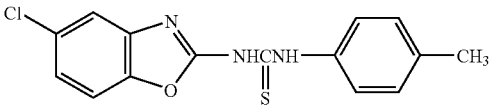
S-33
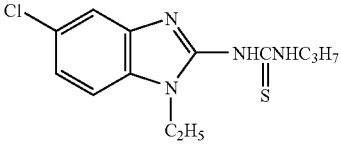
As for a selenium sensitization agent for use in the invention, selenium compound disclosed in conventionally publicly known patents can be used. Usually, an unstable type selenium compound and/or non-unstable type selenium compound is used by adding it to an emulsion, which is stirred at high temperatures (preferably 40° C. or more) for a certain period of time. As for an unstable type selenium compound, preference is given to using compounds described in Japanese Patent Application Publication (JP-B) Nos. 44-15748 and 43-13489, and JP-A Nos. 4-25832 and 4-109240.

Specific examples of the unstable selenium sensitization agent include isoselenocyanates (for example, aliphatic isoselenocyanates such as allyl isoselenocyanate), selenoureas, selenoketones, selenoamides, selenocarboxylic acids (such as 2-selenopropionic acid and 2-selenobutyric acid), selenoesters, diacylselenides (such as bis(3-chloro-2,6-dimethoxybenzoyl)selenide), selenophosphates, phosphine selenides and colloidal metal selenium.

Although preferable genres of the unstable type selenium compound are described above, these are not restrictive. As for an unstable type selenium compound as a sensitizer for a photographic emulsion, it is generally understood that structure of the compound is not very important as long as selenium is unstable, and that an organic portion of a selenium sensitizer molecule has no role except for supporting the selenium and allowing the molecule to exist in an emulsion in an unstable figure. In the invention, unstable selenium compounds included in such wide-ranging concept are used advantageously.

As for the non-unstable type selenium compound for use in the invention, compounds described in JP-B Nos. 46-4553, 52-34492 and 52-34491 can be used. Examples of the non-unstable type selenium compound include selenious acid, potassium selenocyanate, selenazoles, quaternary salt of selenazoles, diaryl selenide, diaryl diselenide, dialkyl selenide, dialkyl diselenide, 2-selenazolidine-dione, 2-selenooxazolidine-dione and derivatives thereof.

These selenium sensitizers are dissolved in water, or an organic solvent such as methanol or ethanol or a mixture thereof, and added at chemical sensitization. Preferably it is added prior to start of the chemical sensitization. The selenium sensitizer to be used is not limited to one kind, but two or more kinds of the aforementioned selenium sensitizers can be used together. Simultaneous use of an unstable selenium compound and a non-unstable selenium compound is preferable.

An addition amount of a selenium sensitizer for use in the invention varies depending on an activity of the selenium sensitizer to be used, kind and size of silver halide, and temperature and time period of maturing and, preferably, is $1\times10^{-8}$ mol or more per 1 mol of silver halide. More preferably, it is $1\times10^{-7}$ mol or more, and $5\times10^{-5}$ or less. When a selenium sensitizer is used, temperature at chemical maturing is preferably 40° C. or more, and 80° C. or less. pAg and pH can be selected arbitrarily. For example, referring to pH, the effect of the invention can exert in a wide range of 4 to 9.

Use of selenium sensitization in combination with sulfur sensitization or noble metal sensitization, or with both of them is more preferable. Further, in the invention, preferably thiocyanate is added to the silver halide emulsion at chemical sensitization. As thiocyanate, potassium thiocyanate, sodium thiocyanate, ammonium thiocyanate or the like is used. Usually, it is added as an aqueous solution or after being dissolved in a water-soluble solvent. The addition amount is preferably from $1\times10^{-5}$ mol to $5\times10^{-2}$ mol, more preferably from $5\times10^{-5}$ mol to $5\times10^{-3}$ mol per 1 mol of silver halide.

The grain contained in the dislocation tabular grain emulsion or epi-emulsion for use in the invention may be subjected to chemical sensitization at the surface or arbitrary position from the surface. When the inside is subjected to chemical sensitization, the method described in JP-A No. 63-264740 can be referred to. As for the grain contained in the epi-emulsion, preferably it is subjected to chemical sensitization after forming clearly the epitaxially joined silver halide protrusion. In this case, a less chloride ion content in the protrusion tends to provide chemical sensitization internally, and formation of the protrusion in the presence of a thiocyanic acid ion tends to provide chemical sensitization more internally.

The surface development sensitivity and total development sensitivity in the invention is defined according to the following equation respectively, when following surface development (A) and total development (B) are carried out after exposing an emulsion-coated member for from 1 to 1/100 second.

Equation: S=100/Eh

In the equation, S represents sensitivity, and Eh represents an exposure amount necessary for obtaining a density just one-half of the sum of the maximum density ($D_{max}$) and the minimum density ($D_{min}$).

Surface Development (A)

Develop the member using a developer (A) with the following prescription at 20° C. for 10 minutes

| | |
|---|---|
| N-methyl-p-aminophenol (hemisulfate) | 2.5 g |
| ascorbic acid | 10 g |
| sodium metaborate.tetrahydrate | 35 g |
| potassium bromide | 1 g |
| Water | fill up to 1 L |

Total Development (B)

Develop the member in aforementioned developer (A) further including sodium thiosulfate by 0.5 g/L at 20° C. for 10 minutes The study of the invention has revealed that, when the epi-emulsion is treated with a treatment including a silver halide solvent (such as KSCN) such as a reversal processing, a total development sensitivity higher than a surface development sensitivity is advantageous for obtaining high sensitivity.

In the epi-emulsion according to the invention, a mode, in which silver halide grains havnig no dislocation line except for an epitaxially joined portion account for 70% or more of the total projected areas, is preferable. Further, a mode, in which silver halide grains having no dislocation line in any region including an epitaxially joined portion account for 70% or more of the total projected areas, is more preferable.

Next, explanation will be given about a method for manufacturing a tabular grain with a (111) plane as a principal plane (hereinafter, referred to as "(111) tabular grain"), which is one of preferable embodiments of the dislocation tabular grain and host tabular grain according to the invention.

The (111) tabular grain for use in the invention can be prepared by a method obtained by improving methods described in Cleve, "Photography Theory and Practice (1930)", p13; Gutuff, Photographic Science and Engineering, Vol. 14, pp 248–257 (1970); U.S. Pat. Nos. 4,434,226, 4,414,310, 4,433,048 and 4,439,520, and Great Britain patent No. 2,112,157.

Usually, preparation of the (111) tabular grain consists of a combination of three processes including nucleus formation, maturing and growth. In the nucleus formation process, use of a gelatin with a small methionine content as described in U.S. Pat. Nos. 4,713,320 and 4,942,120, conduct of nucleus formation at a high pBr as described in U.S. Pat. No. 4,914,014, and conduct of nucleus formation at short times as described in JP-A No. 2-222940 are extremely effective in the nucleus formation process of the grain for use in the invention. Addition of an aqueous silver nitrate solution, an aqueous halogen solution and a low molecular weight oxidized gelatin within one minute in the presence of a low molecular weight oxidized gelatin under stirring at a temperature of from 20° C. to 40° C. is preferable in particular in the invention. At this time, preferable pBr and pH of the system is 2 or more and 7 or less, respectively. Preferable concentration of the aqueous silver nitrate solution is 0.6 mol/L or less.

In the maturing process, conduct in the presence of a low concentration base as described in U.S. Pat. No. 5,254,453, and conduct at a high pH as described in U.S. Pat. No. 5,013,641 may be utilized in the maturing process of the tabular grain according to the invention. The polyalkyleneoxide compound described in U.S. Pat. Nos. 5,147,771, 5,147,772, 5,147,773, 5,171,659, 5,210,013 and 5,252,453 may be added in the maturing process or subsequent growth process. In the invention, the maturing process is carried out at a temperature of from 50° C. to 80° C. preferably. Preference is given to decreasing pBr to 2 or less just after nucleus formation or in process of the maturing. Further, preferably an additional gelatin is added at a time from just after the nucleus formation to the end of the maturing. Particularly preferable gelatin is one in which 95% or more of the amino groups are modified to be succinate or trimellitate.

Usually, the growth process is carried out according to a publicly known method in which an aqueous silver nitrate solution and an aqueous halide solution are added simultaneously. And a method is also usable in which an aqueous silver nitrate solution and an aqueous halogen solution containing a bromide, and an emulsion containing a fine grain of silver iodide (hereinafter, referred to as a "silver iodide fine grain emulsion") as aforementioned in the paragraph of introducing of a dislocation line to a dislocation tabular grain are added simultaneously, as describe in U.S. Pat. Nos. 4,672,027 and 4,693,964.

In the growth process in the invention, an external stirrer as described in JP-A No. 10-043570 also can be used. In other words, it is a method in which, by using the stirrer, an emulsion containing fine grains of silver bromide or silver iodobromide or silver iodochlorobromide (hereinafter, also referred to as a "ultrafine grain emulsion") prepared just before the addition is added continuously at tabular grain growth to allow the ultrafine grain emulsion to dissolve to grow the tabular grain. An external mixer for preparing the ultrafine grain emulsion has a strong stirring capacity and the mixer is added with an aqueous silver nitrate solution, an aqueous halogen solution and gelatin. The gelatin may be mixed with an aqueous silver nitrate solution and/or an aqueous halogen solution prior to, or just prior to the addition, or added solely as an aqueous solution. A gelatin with an average molecular weight smaller than usual one is preferable. From 10000 to 50000 is particularly preferable. Use of a gelatin whose amino groups have been modified to phthalate or succinate or trimellitate by 90% or more and/or use of an oxidized gelatin whose methionine content has been decreased is particularly preferable.

Next, explanation will be given about a compound represented by Formula (A). Formula (A)

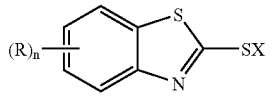

In Formula (A), X represents a hydrogen atom or an alkaline metal atom (such as lithium, sodium or potassium). It is a hydrogen atom, Na or K preferably, and an hydrogen atom or Na more preferably. R represents a hydrogen atom, a halogen atom (such as fluorine, chlorine or bromine) or a $C_{1-5}$ alkyl group. n represents an integer of 1 to 4 and, preferably, is 1 or 2. When n is 2 or more, each of the plural Rs may be the same or different.

Hereinafter, preferable specific examples of the compounds represented by Formula (A) will be illustrated, however, the invention is not intended to be restricted to these.

A-1

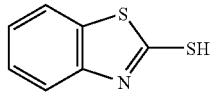

A-2

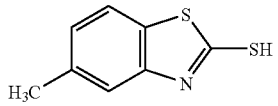

A-3

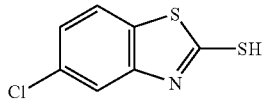

A-4

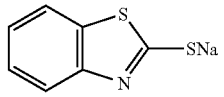

A-5

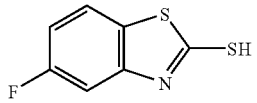

A-6

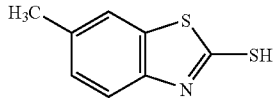

A-7

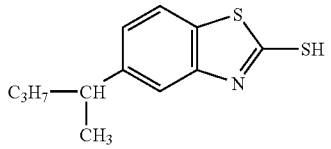

A-8

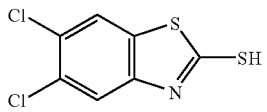

The compound that is added to the silver halide emulsion according to the invention and represented by Formula (A) may be added at an arbitrarily position in the preparation process. Although there is no particular restriction, the addition amount is in a range from $1\times10^{-6}$ to $1\times10^{-2}$ mol preferably, and $1\times10^{-5}$ to $1\times10^{-3}$ mol more preferably per 1 mol of the silver halide. Addition temperature is not particularly restricted, but addition at a temperature in a range from 30° C. to 75° C. is preferable.

Next, a method for manufacturing a tabular grain having a principal plane of a (100) plane (hereinafter, referred to as "(100) tabular grain"), which is another preferable embodiment in the invention. Preferably the (100) tabular grain is formed into the grain in the presence of a polyvinylalcoholl derivative (hereinafter, referred to as "polymer (P)"). The polymer (P) adsorbs strongly to the silver halide grain to exert a strong protective colloid ability and inhibits an additional lamination of the silver halide on the adsorbed face.

A tabular nucleus formation of the (100) tabular grain is completed by adsorption of the polymer (P) to a pair of (100) planes capable of forming the principal plane of the silver halide grain and adsorption of gelatin to side planes (other planes). The tabular nucleus may be formed (a) by adding $Ag^+$ ion and $X^-$ ion to an aqueous solution including the polymer (P) and gelatin in advance, or (b) by adding $Ag^+$ ion and $X^-$ ion to an aqueous solution including gelatin alone to form a fine crystal followed by adding the polymer (P). When a successful control of adsorbability of the polymer (P) and the gelatin is possible at a more unstable initial stage of the nucleus formation, forming the tabular nucleus according to the method (a) is advantageous to realize mono-dispersion of the thickness.

The adsorbability of the polymer (P) and gelatin can be controlled by adjusting kind (such as molecular weight, kind of a substituent etc.) of the polymer (P) and gelatin and an amount thereof to be used, and adjusting pH, pAg and the like in formation of the tabular nucleus. For example, the polymer (P) with a larger molecular weight exerts a stronger adsorbability, therefore, in this case such an adjustment is necessary that the molecular weight of the gelatin is also increased to achieve a balance of the adsorbability, or the amount of the gelatin to be used is increased to achieve the balance of the adsorbability. In the nucleus formation, the highest priority is to realize a uniform adsorption state of the polymer (P) and gelatin among grains. At this time, a less amount of the polymer (P) to be used is preferable and it is necessary to select a kind and amount of gelatin to be used corresponding to it, and to select pH and pAg suitable for it. The adsorbability depends on relative relationship among crystal phase of a AgX grain surface, the polymer (P) and the gelatin, and is not determined uniquely.

In processes of maturing and growth after the nucleus formation, balance of the adsorbability is required to change according to need. Although a maturing process is not necessary when all the tabular nuclei formed by the method (a) or (b) are the preferable tabular nucleus (the aforementioned state in which the polymer (P) adsorbs to a pair of (100) planes capable of forming the principal plane and gelatin adsorbs to side faces (other faces)), the process is necessary when an unwanted nucleus crystal is mixed. At this time, the unwanted crystal is allowed to disappear by Ostwald maturing, during which the adsorbability of the polymer (P) having a strong protective colloid ability is weakened to prompt the maturing. Creation of an atmosphere to allow easy maturing by rising temperature, or addition of $Ag^+$ ion and $X^-$ ion to prompt the maturing is also preferable.

During a growth process of the (100) tabular grain, preferably $Ag^+$ and $X^-$ are added in such a way that they keep a low supersaturated condition in a state of the maximum difference between adsorbabilities of the polymer (P) and gelatin or, in other words, in a state of the maximum difference between the solubilities of the principal plane and side face. In order to generate difference between the adsorbabilities, controlling the adsorbability of the polymer (P) and gelatin by pH is most simple and preferable.

In the (100) tabular grain formation, preference is given to adding a spectral sensitizing dye before the end of the grain formation. Since the polymer (P) adsorbs strongly to the silver halide grain, in order to allow a spectral sensitizing dye to adsorb to the principal plane having a large surface area, the polymer (P) is substituted with a spectral sensitizing dye, while keeping the silver halide surface in a dynamic state (that is, while allowing a new lamination layer to form by addition of a silver ion and halogen ion). Preference is also given to adding gelatin in order to reduce the adsorbability of the polymer (P) relatively to prompt the substitution.

Next, explanation will be given about a method for forming a protrusion of silver halide epitaxially joined to grain surface of the host tabular grain in the epi-grain according to the invention. Formation of the protrusion may be carried out just after formation of the host tabular grain, or after usual desalting which is carried out after the formation of the host tabular grain. Preferably it is carried out just after the formation of the host tabular grain.

Preference is given to using a site-indicating agent in order to form a protrusion in the epi-grain according to the invention. Although various site-indicating agents can be used, preference is given to utilizing a spectral sensitizing dye. Site of the protrusion can be controlled by selecting an amount or kind of a dye to be used. Addition of the spectral sensitizing dye by an amount corresponding to from 50% to 200% of the saturated coating amount is preferable, and from 70% to 150% is more preferable. Usable dyes include cyanine dye, merocyanine dye, conjugated cyanine dye, conjugated merocyanine dye, holopolar cyanine dye, hemicyanine dye, styryl dye and hemioxonol dye. The particularly useful dye is a dye belonging to cyanine dye. To these dyes, any of nuclei utilized usually as a basic heterocycle nucleus for cyanine dyes can be applied. That is, examples of the applicable nucleus include pyrroline nucleus, oxazoline nucleus, thiozoline nucleus, pyrrole nucleus, oxazole nucleus, thiazole nucleus, selenazole nucleus, imidazole nucleus, tetrazole nucleus and pyridine nucleus; nuclei formed by fusing an alicyclic hydrocarbon ring to these nuclei; and nuclei formed by fusing an aromatic hydrocarbon ring to these nuclei, that is, for example, indolenine nucleus, benzoindolenine nucleus, indole nucleus, benzooxazole nucleus, naphthooxazole nucleus, benzothiazole nucleus, naphthothiazole nucleus, benzoselenazole nucleus, benzoimidazole nucleus and quinoline nucleus. These nuclei may have a substituent on a carbon atom.

Each of these spectral sensitizing dyes may be used independently, or a combination of them may be used. A combination of spectral sensitizing dyes are used often particularly for the purpose of supersensitization. The typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GBP Nos. 1,344,281 and 1,507,803, JP-B Nos. 43-4936 and 53-12375, JP-A Nos. 52-110618 and 52-109925. Together with the spectral sensitizing dye, a dye having no spectral sensitizing effect itself, or a substance having no substantial absorption of visible light and representing supersensitization may be added simultaneously or separately.

Relating to a method for forming the protrusion of the epi-emulsion, a mode in which a spectral sensitizing dye is added prior to formation of the protrusion as a site-indicating agent is preferable, and further a mode in which a spectral sensitizing dye is added after formation of the protrusion is also preferable. An additionally added dye has an action of keeping the protrusion stable, as well as a merit of achieving a higher sensitivity. In this case, the same kind of dye as those having been used prior to the protrusion formation may be used, or another kind of dye may be included.

The silver halide protrusion of the epi-emulsion according to the invention can be formed by adding a solution containing silver nitrate. At this time, a method in which an aqueous silver nitrate solution and a halide solution are added simultaneously is often employed, but the latter may also be added separately from a silver nitrate solution. Further, it may be formed by adding a silver bromide fine grain, silver iodide fine grain and silver chloride fine grain with a grain diameter smaller than thickness of the host tabular grain, or a fine grain consisting of a mixed crystal thereof, or the like. In the method of adding an aqueous silver nitrate solution and a halide solution simultaneously, a preferable method is that the addition is carried out while keeping pBr of the system constant. Addition time of the silver nitrate solution is from 30 seconds to 300 minutes preferably, and from 1 minute to 200 minutes particularly preferably. Concentration of the silver nitrate solution is 1.5 mol/L or less preferably and, particularly preferably, 1.0 mol/L or less. pBr during silver halide protrusion formation is 3.5 or more preferably and, particularly preferably, 4.0 or more. Preferable temperature ranges from 35° C. to 45° C. pH ranging from 3 to 8 is preferable, and from 5 to 8 is more preferable.

Inclusion of pseudo-halide in the protrusion is possible by adding a pseudo-halide salt prior to or in the protrusion formation, or incorporating it in a halide solution to be added simultaneously with silver nitrate. It is possible by using, for example, KCN, KSCN or KSeCN.

In the invention, pseudo-halide content in the protrusion portion can be measured according to the following method. A planar silver halide grain in silver halide photographic photosensitive material is taken out by treating the photosensitive material with a proteolytic enzyme and carrying out centrifugation. The grains are re-distributed and placed on a cupper mesh provided with a support membrane. The protrusion portion of the grain is subjected to point analysis by using an analytical electron microscope while narrowing down the spot diameter to 2 nm or less to measure the pseudo-halide content. The pseudo-halide content can be obtained by treating a silver halide grain of a known content in a same way to give a calibration curve and obtaining previously a ratio between Ag intensity and pseudo-halide intensity. For example, in the case of $SCN^-$, it is obtained from the ratio of Ag intensity and S intensity. As for an analytical radiation source of the analytical electron microscope, a field emission type electron gun, which has a high electron density, is more suitable than a gun employing a thermoelectron. By narrowing down the spot diameter to 1 nm or less, a pseudo-halide content of the protrusion portion can be analyzed easily. When the inter-grain coefficient of variation of the pseudo-halide contents for the protrusion portion is 30% or less, usually 20 grains are analyzed and averaged to give the pseudo-halide content. When the inter-grain coefficient of variation of the pseudo-halide contents for the protrusion portion is 20% or less, usually 10 grains are analyzed and averaged to give the pseudo-halide content. The inter-grain coefficient of variation of the pseudo-halide content for the protrusion portion is 20% or less preferably.

Next, explanation will be given about a hole trap zone, which is included advantageously in the silver halide grain according to the invention.

The silver halide grain according to the invention includes a hole trap zone in the grain preferably. The hole trap zone in the invention means an area having a function of capturing a so-called hole, such as a hole generating in pairs with a photoelectron generating due to photoexcitation. Various methods can create such a hole trap zone and, in the invention, creation by reduction sensitization is desirable.

In the case of the epi-emulsion, the hole trap zone may exist in the host grain, the protrusion epitaxially joined to it, or both of them, but a mode in which the zone exists only in the host grain is preferable. When it is created to the host grain, it may exist within the grain, on the grain surface, or both within and on the surface of the grain, arbitrarily. However, since a reduced silver nucleus is destroyed readily by oxygen and moisture in air, in the case where an emulsion itself or a photosensitive material is stored for a long period of time, a hole trap zone within the grain is preferable.

Usually, the process for manufacturing a silver halide emulsion is classified roughly to processes of grain formation, desalting and chemical sensitization. The grain formation is divided into nucleus formation, maturing, growth etc. These processes are not carried out without variation, but order of the processes may be reversed, or repeated for some process. Reduction sensitization may be conducted to the silver halide emulsion at any process of respective manufacturing processes, basically. The reduction sensitization may be conducted at nucleus formation, which is an initial stage of the grain formation, at physical maturing or at growth and, further, may be conducted prior to chemical sensitizations other than the reduction sensitization or subsequent to the chemical sensitization. In the case of conducting a chemical sensitization in combination with gold sensitization, preferably the reduction sensitization is carried out prior to the chemical sensitization in order to inhibit generation of an undesirable fog. The most preferable method is to carry out the reduction sensitization during growth of the host grain. Here, "during growth" means that it includes a method in which the silver halide grain is subjected to a reduction sensitization in a state of growth by physical maturing or by addition of a water-soluble silver salt and water-soluble alkali halide, and a method in which the grain is subjected to a reduction sensitization on the way of growth while stopping the growth temporarily followed by an additional growth.

As for the reduction sensitization in the invention, any one can be selected from a method in which a silver halide emulsion is added with a publicly known reducer, a method called as silver maturing in which growth or maturing is carried out in a low pAg atmosphere of pAg 1 to 7, and a method called as high pH maturing in which growth or maturing is carried out in a high pH atmosphere of pH 1 to 7. Two or more methods may be used in combination.

A method of adding a reduction sensitizer is a preferable method in point of making a delicate adjustment of a reduction sensitization level possible. As for the reduction sensitizer, primary silver salt, amine and polyamine acid, hydrazine derivatives, formamidinesulfinic acid, silane compound, borane compound, ascorbic acid and derivatives thereof etc. are publicly known. In the invention, a kind or a combination of two or more kinds may be usable by selecting from these publicly known compounds. Examples of preferable compound as the reduction sensitizer include stannous chloride, thiourea dioxide, dimethylamine borane, ascorbic acid and derivatives thereof. Addition amount of the reduction sensitizer must be determined according to a kind of the reduction sensitization agent and an emulsion manufacturing condition, and the amount ranging from $1\times10^{-7}$ to $1\times10^{-3}$ mol per 1 mol of the silver halide is appropriate. But, in the case of ascorbic acid compound, the amount in a range from $5\times10^{-5}$ to $1\times10^{-1}$ mol is appropriate.

The reduction sensitizer can be dissolve in water or a solvent such as alcoholls, glycols, ketones, esters and amides, and added in grain formation, or prior or subsequent to chemical sensitization. Although it may be added at any stage of the emulsion manufacturing processes, but a particularly preferable method is to add it in the grain growth. It may be added to the reaction vessel previously, but addition of it at an appropriate time in the grain formation is more preferable. Further, grain formation may be carried out by adding previously a reduction sensitizer to an aqueous solution of a water-soluble silver salt or a water-soluble alkali halide, and by using the aqueous solution. Such a method is also preferable that a solution of the reduction sensitizer is added in several times, or continuously for a long period of time, along with grain formation.

In order to give the hole trap zone only within the grain, inclusion of at least one compound selected from compounds represented by following Formula (I), (II) or (III) is effective.

Formula (I): $R—SO_2S—M$

Formula (II): $R—SO_2S—R_1$

Formula: (III): $R—SO_2S—Lm—SSO_2—R_2$

Where, R, $R_1$ and $R_2$ each may be the same or different and represents an aliphatic group, an aromatic group or a heterocyclic group; M represents a cation; L represents a bivalent connecting group; and m is 0 or 1. Compounds represented by Formula (I), (II) or (III) may be polymers containing a bivalent group derived from the structure represented by (I) to (III) as a repeating unit. In Formula (II), R and RI may connect with each other to form a ring. In Formula (III), at least two of R, $R_2$ and L may connect with each other to form a ring.

A more detailed explanation will be given about compounds represented by Formula (I), (II) or (III). When each of R, $R_1$ and $R_2$ is an aliphatic group, it is a saturated or unsaturated, strait- or branched-chain or ringed aliphatic hydrocarbon group and, preferably, an alkyl group having from 1 to 22 carbon atoms, or an alkenyl or alkynyl group having from 2 to 22 carbon atoms, which may have a substituent. Examples of the alkyl group include methyl, ethyl, propyl, butyl, pentyl, hexyl, octyl, 2-ethylhexyl, decyl, dodecyl, hexadecyl, octadecyl, cyclohexyl, isopropyl and t-butyl.

Examples of the alkenyl include allyl and butenyl. Examples of the alkynyl group include propagyl and butynyl. The aromatic group for R, $R_1$ and $R_2$ includes an aromatic group of a single or condensed ring and, preferably, has from 6 to 20 carbon atoms. Examples of it include a phenyl group and naphthyl group. They may have a substituent.

As for the heterocyclic group for R, $R_1$ and $R_2$, a 3- to 15-membered ring including at least one element selected from nitrogen, oxygen, sulfur, selenium and tellurium can be mentioned. Examples of the heterocycle for the heterocyclic group include a pyrrolidine ring, a piperidine ring, a pyridine ring, a tetrahydrofran ring, a thiophene ring, an oxazole ring, a thiazole ring, an imidazole ring, a benzothiazole ring, a benzoxazole ring, a benzimidazole ring, a selenazole ring, a benzoselenazole ring, a tellurazole ring, a triazole ring, a benzotriazole ring, a tetrazole ring, an oxadiazole ring and a thiadiazole ring.

Examples of the substituent for R, $R_1$ and $R_2$ include an alkyl group (such as methyl, ethyl and hexyl), an alkoxy group (such as methoxy, ethoxy and octyloxy), an aryl group (such as phenyl, naphthyl and tolyl), a hydroxy group, a halogen atom (such as fluorine, chlorine, bromine and iodine), an aryloxy group (such as phenoxy), an alkylthio group (such as methylthio and butylthio), an arylthio group (such as phenylthio), an acyl group (such as acetyl, propyonyl, butyryl and valeryl), a sulfonyl group (such as methylsulfonyl and phenylsulfonyl), an acylamino group (such as acetylamino and benzamino), a sulfonylamino group (such as methanesulfonylamino and benzensulfonylamino), an acyloxy group (such as acetoxy and benzoxy), a carboxyl group, a cyano group, a sulfo group and an amino group.

As for a bivalent connecting group represented by L, an atom or atoms including at least one selected from C, N, S and O can be mentioned. Specific examples include an alkylene group, an alkenylene group, an alkynylene group, an arylene group, —O—, —S—, —NH—, —CO—, $—SO_2—$ solely and groups consisting of combinations thereof.

A preferable group as L is a bivalent aliphatic group or a bivalent aromatic group. Examples of the bivalent aliphatic group for L include $—(CH_2)_n—$ (n=1 to 12), $—CH_2—CH{=}CH—CH_2—$, $—CH_2C{\equiv}CCH_2—$ and a xylylene group. Examples of the bivalent aromatic group include phenylene and naphthylene. These substituents may be further substituted with an aforementioned substituent.

What is preferable as M is a metal ion or an organic cation. Examples of the metal ion include a lithium ion, a sodium ion and a potassium ion. Examples of the organic cation include an ammonium ion (such as ammonium, tetramethylammonium and tetrabutylammonium), a phosphonium ion (tetraphenylphosphonium) and a guanidine group.

As for specific examples of the compound represented by any of the Formulas (I), (II) or (III), those disclosed in JP-A No. 10-268456 can be mentioned, which are preferably incorporated herein as a part of the specification of the application.

The compound represented by Formulas (I), (II) or (III) can easily be synthesized by the methods described in JP-A No. 54-1019 and GBP No. 972,211.

The compound represented by any of the Formulas (I), (II) or (III) is added preferably by from $1\times10^{-7}$ to $1\times10^{-1}$ mol per 1 mol of the silver halide. An addition amount from $1\times10^{-5}$ to $1\times10^{-2}$ is further preferable, and form $1\times10^{-5}$ to $1\times10^{-3}$ mol/mol Ag is particularly preferable.

In order to add the compound represented by Formula (I), (II) or (III) in the manufacturing process, a method usually used for adding an additive to a photographic emulsion can be applied. For example, it may be added, in the case of a water-soluble compound, as an aqueous solution of an appropriate concentration, or, in the case of a water-insoluble or hardly soluble compound, as a solution prepared by dissolving the compound in a solvent selected from appropriate water-miscible organic solvents such as alcoholls, glycols, ketones, esters and amides, that do not give an adverse effect to photographic properties.

The compound represented by Formulas (I), (II) or (III) may be added at any stage of manufacture, that is, in grain formation, or prior to or subsequent to chemical sensitization. A preferable method is to add the compound prior to or in the operation of the reduction sensitization. A particularly preferable method is to add it in the grain growth.

It may be added to a reaction vessel previously, but added at an appropriate time in the grain growth more preferably. Or, the compound represented by Formula (I), (II) or (III) is added previously to one of aqueous solutions of a water-soluble silver salt and a water-soluble alkali halide, and the aqueous solutions may be used for the grain formation. Further, addition of a solution of the compound represented by Formula (I), (II) or (III) in several times, or for a long period of time continuously, along with the grain formation, is also a preferable method.

Among the compounds represented by Formula (I), (II) or (III), the most preferable compound for the invention is the compound represented by Formula (I).

As another method for giving the hole trap zone only in the inside of the grain, a method using an oxidizer is known. Both inorganic and organic oxidizers may be usable. Examples of the inorganic oxidizer include ozone, hydrogen peroxide and addition products thereof (such as $NaBO_3H_2O_2.3H_2O$, $2NaCO_3.3H_2O_2$, $Na_4P_2O_7.2H_2O_2$, $2Na_2SO_4.H_2O_2.H_2O$), and oxyacid salts such as peroxy acid salts (such as $K_2S_4O_8$, $K_2C_2O_6$, $K_4P_2O_8$), peroxy complex compounds (such as $K_2[TiO_2C_2O_4].3H_2O$, $4K_2SO_4.TiO_2.OH.2H_2O$, $Na_3[VOO_2(C_2O_4)_2.6H_2O]$), permanganates (such as $KMnO_4$) and chromates (such as $K_2Cr_2O_7$), halogen elements such as iodine and chlorine, perhalogenates (such as potassium periodate) and salts of metals of high valency (such as potassium hexacyano-ferrate (III)). Examples of the organic oxidizer include quinones such as p-quinone, organic peroxides such as peracetic acid and perbenzoic acid, compounds capable of releasing an active halogen (such as N-bromosuccinimide, chloramine T and chloramine B). Preferable addition amount, addition time and addition method are the same as those for the case of the compound represented by Formulas (I), (II) or (III).

The oxidizer which is preferable in the invention includes ozone, hydrogen peroxide and addition products thereof, halogen elements, thiosulfonates and quinones. The particularly preferable ones are thiosulfonic acid compounds represented by Formulas (I), (II) or (III), and the most preferable ones are compounds represented by Formula (I).

In order to dispose the hole trap zone on grain surface, the aforementioned reduction sensitization may be conducted after 90% or more (silver amount) of the host grain have been formed.

Next, explanation will be given about a temporary electron trap zone which the silver halide grain of the invention has.

The temporary electron trap zone in the invention means a region having a function of temporarily trapping a photoelectron generated by photoexcitation until it forms a latent image in an image-forming step. Such a temporary electron trap zone can be realize by doping a transition metal complex.

Specific example of the transition metal complex which is appropriate as a dopant to be incorporated preferably to the inside and/or surface of the silver halide grain will be given below. Preferable metals for use as a central metal ion of a transition metal complex include iron, ruthenium, iridium, cobalt, osmium, rhodium and palladium. Use of these metal ions, while accompanying ligands, as a 6-coordination octahedron type complex is more preferable. When an inorganic compound is used as a ligand, use of a cyanate ion, halide ion, thiocyan ion, hydroxide ion, peroxide ion, azide ion, nitrite ion, water, ammonia, nitrosyl ion or thionitrosyl ion is more preferable. The aforementioned ligands may be coordinated to any of metal ions. The coordination sites of these metal ions may be coordinated with the same kind of ligands respectively, or may be coordinated with multiple kinds of ligands at the same time. Further, organic compounds may also be used as the aforementioned ligand. When organic compounds are used as a ligand, chain-shaped compounds having 5 or less of carbons in the principal chain and/or 5- or 6-membered heterocyclic compounds are preferable. Among them, compounds including a nitrogen atom, phosphor atom, oxygen atom or sulfur atom in a molecule as a ligand to a metal ion are more preferable, and furan, thiophene, oxazole, isooxazole, thiazole, isothiazole, imidazole, pyrazole, triazole, furazane, pyran, pyridine, pyridazine, pyrimidine and pyrazine are particularly preferable. Further, compounds having these compounds as a basic skeleton to which a substituent is introduced are also mentioned preferably. The transition metal complex is incorporated preferably by $1\times10^{-10}$ to $1\times10^{-2}$ mol, and more preferably by $1\times10^{-8}$ to $1\times10^{-1}$ mol per 1 mol of silver.

In the transition metal complex, as the metal used as the central metal ion, iron, ruthenium or iridium is particularly preferable. When the central metal is iron or ruthenium, examples of preferable combination with the ligand include an iron ion and cyanate ion, and a ruthenium ion and cyanate ion. In these combinations, more preferably the cyanate ion has a majority of coordination number to iron or ruthenium being the central metal, and more preferably, any of thiocyan, ammonia, water, nitrosyl ion, dimethylsulfoxide, pyridine, pyrazine and 4,4'-bipyridine accounts for remaining coordination sites. And occupation of all the 6 coordination sites of the central metal with cyanate ions to form a hexacyanoiron complex or hexacyanoruthenium complex is most preferable. Specific preferable examples when iron or ruthenium is used as the central metal include $[Fe(CN)_6]^{4-}$, $[Fe(CN)_6]^{3-}$, $[Ru(CN)_6]^{4-}$, $[Fe(pyrazine)(CN)]^{4-}$, $[Fe(CO)(CN)_5]^{3-}$, $[RuF_2(CN)_4]^{4-}$, $[Ru(CN)_5(OCN)]^{4-}$, $[Ru(CN)_5(N_3)]^{4-}$, $[Fe(CN)_3Cl_3]^{3-}$ and $[Ru(CO)_2(CN)_4]^{1-}$. On the other hand, when iridium is used as the central metal, preferable ligands are a fluoride ion, chloride ion, bromide ion, iodide ion, cyanate ion and thiocyanic acid ion and, among them, a chloride ion or bromide ion is more preferable. Further, these lignads have a majority of coordination number to iridium, and occupation of remaining coordination sites with any of thiocyan, ammonia, water, nitrosyl ion, dimethylsulfoxide, pyridine, pyrazine and 4,4'-bipyridine is also preferable. Specific preferable examples when iridium is used as the central metal of a metal complex include $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, $[IrBr_3(H_2O)_3]^{+}$, $[Ir(CN)_6]^{3-}$, $[IrBr(CN)_5]^{3-}$, $[IrBr_2(CN)_4]^{3-}$, $[Ir(CN)_5(H_2O)]^{2-}$, $[Ir(CN)_4(oxalate)]^{3-}$ and $[In(NCS)_6]^{3-}$.

Next, explanation will given about other embodiments which are preferable in the silver halide emulsion according to the invention. Preferably the silver halide emulsion according to the invention includes an appropriate amount of a calcium ion and/or magnesium ion. It improves graininess to enhance an image quality, as well as improves storability. The appropriate range is from 400 to 2,500 ppm for calcium and/or from 50 to 2,500 ppm for magnesium and, more preferably, from 500 to 2,000 ppm for calcium and from 200 to 2,000 ppm for magnesium. Here, the phrase "from 400 to 2,500 ppm for calcium and/or from 50 to 2,500 ppm for magnesium" means that concentration of at least one of calcium and magnesium falls within the defined values. A content of calcium or magnesium higher than these values is not preferable since it makes a calcium salt, a magnesium salt, or an inorganic salt held previously by gelatin etc. precipitate to cause a trouble at manufacturing the photosensitive material. Here, the calcium or magnesium content is represented for all the compounds containing calcium or magnesium such as a calcium ion, magnesium ion, calcium salt and magnesium salt by mass converted to a calcium atom or magnesium atom, and by concentration per unit mass of the emulsion.

Calcium added to the silver halide emulsion according to the invention may be added at an arbitrary time in the emulsion manufacturing process, but a preferable embodiment is that it is added prior to formation of the silver halide protrusion. Further, a mode in which calcium is added by topping after formation of the protrusion is also preferable.

Calcium is added, usually, in a form of calcium salt. As a calcium salt, calcium nitrate and calcium chloride are preferable, and calcium nitrate is most preferable. Similarly, adjustment of a magnesium content may be carried out by adding magnesium salt at the emulsion manufacturing. As the magnesium salt, magnesium nitrate, magnesium sulfate and magnesium chloride are preferable, and magnesium nitrate is most preferable. Calcium or magnesium may be determined quantitatively with an ICP emission spectral analysis method. Calcium and magnesium may be used separately, or in a mixture thereof. Inclusion of calcium is more preferable.

Use of gelatin is advantageous as protective colloid for use in preparing the emulsion, and as a binder for other hydrophilic colloidal layers according to the invention. However, other hydrophilic collides may be used. Usable examples include gelatin derivatives, graft polymers of gelatin and other polymers; proteins such as albumin and casein; cellulose derivatives such as hydroxyethyl cellulose, carboxymethyl cellulose and cellulose sulfate esters; saccharic derivatives such as sodium alginate and starch derivatives; and various kinds of synthetic hydrophilic polymers such as homopolymers and copolymers including polyvinyl alcohol, partialy acetalized polyvinyl alcohol, poly-N-vinyl pyrrolidone, polyacrylic acid, polymethacrylic acid, polyacrylamide, polyvinyl imidazole and polyvinylpyrazole.

As for gelatin, in addition to lime-processed gelatin, acid-treated gelatin, and enzyme-processed gelatin as described in Bull. Soc. Sci. Photo, Japan, No. 16, p. 30 (1966) may be usable, and further hydrolysates and enzyme hydrolysates of gelatin may be usable.

The emulsion according to the invention is, preferably, washed with water to desalt and made into a protective colloid dispersion liquid using a fleshly prepared protective colloid dispersion. Temperature of the water washing can be selected corresponding to a purpose, and selection in a range from 5 to 50° C. is preferable. pH at water washing can also be selected corresponding to a purpose, and selection in a range from 2 to 10 is preferable, and from 3 to 8 is more preferable. pAg at water washing can also be selected corresponding to a purpose, and selection in a range from 5 to 10 is preferable. As for the water washing method, a method selected from a noodle washing method, a dialysis using a semi-permeable membrane, a centrifugal method, a flocculation precipitation method and an ion-exchange method can be utilized. As for the flocculation precipitation method, it can be selected from methods using sulfate, organic solvent, water-soluble polymer and gelatin derivatives, and the like.

Use of gelatin is advantageous as a protective colloid for use in preparing the emulsion, and as a binder for other hydrophilic colloidal layers according to the invention. However, other hydrophilic colloids may be usable.

Usable examples include gelatin derivatives, graft polymers of gelatin and other polymers; proteins such as albumin and casein; cellulose derivatives such as hydroxyethyl cellulose, carboxymethyl cellulose and cellulose sulfate esters; saccharic derivatives such as sodium alginate and starch derivatives; and various kinds of synthetic hydrophilic polymers such as homopolymers and copolymers including polyvinyl alcohol, partialy acetalized polyvinyl alcohol, poly-N-vinyl pyrrolidone, polyacrylic acid, polymethacrylic acid, polyacrylamide, polyvinyl imidazole and polyvinylpyrazole.

As for gelatin, in addition to lime-processed gelatin, acid-treated gelatin, and enzyme-processed gelatin as described in Bu11. Soc. Sci. Photo, Japan, No. 16, p. 30 (1966) may be usable, and further hydrolysates and enzyme hydrolysates of gelatin may be usable.

The emulsion according to the invention is, preferably, washed with water to desalt and made into a protective colloid dispersion liquid using a fleshly prepared protective colloid dispersion. Temperature of the water washing can be selected corresponding to a purpose, and selection in a range from 5 to 50° C. is preferable. pH at water washing can also be selected corresponding to a purpose, and selection in a range from 2 to 10 is preferable, and from 3 to 8 is more preferable. pAg at water washing can also be selected corresponding to a purpose, and selection in a range from 5 to 10 is preferable. As for the water washing method, a method selected from a noodle washing method, a dialysis using a semi-permeable membrane, a centrifugal method, a flocculation precipitation method and an ion-exchange method can be utilized. As for the flocculation precipitation method, it can be selected from methods using sulfate, organic solvent, water-soluble polymer and gelatin derivatives, and the like.

At preparing the emulsion (for example, at grain formation, desalting process, chemical sensitization, and prior to coating) according to the invention, presence of a salt of metal ion corresponding to a purpose is preferable. Addition of it at the grain formation for the purpose of doping, and after the grain formation and prior to the end of the chemical sensitization for the purpose of using it as a modifier of the grain surface or a chemical sensitizer is preferable. A method for doping it only to a core portion or a shell portion of the grain may be selected in addition to a method for doping it to the whole grain. Examples of the usable dopant include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. Any of these metals can be added only if they are in a salt form that can be dissolved at the grain formation, including ammonium salt, acetate, nitrate, sulfate, phosphate, hydroxide, hexa-coordinated complex and tetracoordinated complex. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the complex may be selected from halo, aco, cyano, canate, thiocyanate, nitrosyl, thionitrosyl, oxo and carbonyl. These metal compounds may be used separately, or as a mixture of two or more kinds.

The metal compound is added preferably after being dissolved in water or an appropriate organic solvent such as methanol or acetone. In order to stabilize the solution, a method of adding an aqueous hydrogen halide solution (such as HCl and HBr) or alkali halide (such as KCl, NaCl, KBr and NaBr) may be employed. Or, an acid, alkali or the like may be added according to need. The metal compound may be added to a reaction vessel prior to the grain formation, or along the grain formation. Further, by adding it to an aqueous solution of a water-soluble silver salt (such as $AgNO_3$) or alkali halide (such as NaCl, KBr or KI), it may be added continuously in the silver halide grain formation. Furthermore, by preparing a solution independent of a water-soluble silver salt and alkali halide, it may be added continuously at an appropriate time in the grain formation. In addition, a combination of various addition methods is preferable.

A method of adding chalcogen compound as described in U.S. Pat. No. 3,772,031 in preparing the emulsion is sometimes useful. In addition to S, Se and Te, cyanate, thiocyanate, selenocyanic acid, carbonate, phosphate or acetate may be present.

In the case of the silver halide grain for use in the invention, at least one of sulfur sensitization, selenium sensitization, gold sensitization, palladium sensitization or noble metal sensitization and reduction sensitization may be provided at an arbitrary process of manufacturing processes of the silver halide photographic emulsion. A combination of two or more kinds of sensitization methods is preferable.

As a particularly useful compound for the purpose of decreasing fog of the silver halide emulsion and preventing increase of fog at storage, a mercaptotetrazole compound having a water-soluble group as described in JP-A No. 4-16838 can be mentioned. JP-A No. 4-16838 also discloses that a combined use of a mercaptotetrazole compound and a mercaptothiadiazole compound enhances storability.

The grain in the emulsion for use in the invention may be chemically sensitized at the surface or an arbitrary portion from the surface, but chemical sensitization of the surface is preferable. In order to chemically sensitize the inside of it, the method described in JP-A 63-264740 may be referred to.

For the purpose of preventing fog in the manufacturing process, storage or photographic treatment of the photosensitive material, or stabilizing photographic properties, various compounds may be incorporated in the photographic emulsion for use in the invention. That is, many compounds known as an anti-fogging agent or stabilizing agent may be added, including thiazoles (such as benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; mercaptotetrazoles (in particular 1-phenyl-5-mercaptotetrazole); mercaptopyrimidines; mercaptotriazines; thioketo compound such as oxazoline thion; azaindenes such as triazaindenes, tetraazaindenes (in particular 4-hydroxy-substituted (1,3,3a,7) tetraazaindenes) and pentaazaindenes. For example, those described in U.S. Pat. Nos. 3,954,474 and 3,982,947, and JP-B 52-28660 are usable. one of preferable compounds is the compound described in JP-A 63-212932. The anti-fogging agent and stabilizing agent may be added at various stages before coating, such as prior to the grain formation, in the grain formation, after the grain formation, in the washing process, at dispersion after the washing, prior to the chemical sensitization, in the chemical sensitization, after the chemical sensitization corresponding to a purpose. In addition to allow them to exert original anti-fogging effect and stabilizing effect, they may be used for various purposes such as controlling crystal habit of the grain, decreasing the grain size, decreasing solubility of the grain, controlling chemical sensitization and controlling alignment of dyes by adding them in preparing the emulsion.

Spectral sensitization of the dislocation tabular grain emulsion for use in the invention by methine dye or the like is also preferable to exert the effect of the invention. Examples of the usable dye include cyanine dye, merocyanine dye, conjugated cyanine dye, conjugated merocyanine dye, holopolar cyanine dye, hemicyanine dye, styryl dye and hemioxonol dye. Particularly useful dyes are those belonging to cyanine dye, merocyanine dye and conjugated merocyanine dye. To these dye, any of nuclei utilized for cyanine dyes as an basic heterocyclic nucleus usually may be applied. That is, examples of the applicable nucleus include a pyrroline nucleus, oxazoline nucleus, thiozoline nucleus, pyrrole nucleus, oxazole nucleus, thiazole nucleus, selenazole nucleus, imidazole nucleus, tetrazole nucleus and pyridine nucleus; nuclei formed by fusing an alicyclic hydrocarbon ring to these nuclei; and nuclei formed by fusing an aromatic hydrocarbon ring to these nuclei, that is, for example, an indolenine nucleus, benzoindolenine nucleus, indole nucleus, benzooxazole nucleus, naphthooxazole nucleus, benzothiazole nucleus, naphthothiazole nucleus, benzoselenazole nucleus, benzoimidazole nucleus and quinoline nucleus. These nuclei may have a substituent on a carbon atom.

To merocyanine dye or conjugated merocyanine dye, as a nucleus of a ketomethylene structure, a 5- to 6-membered heterocyclic nucleus may be applied, including, for example, a pyrazoline-5-one nucleus, thiohydantoin nucleus, 2-thiooxazoline-2,4-dione nucleus, thiazolidine-2,4-dione nucleus, rohdanine nucleus, thiobarbituric acid nucleus.

These sensitizing dyes may be used separately, or as a combination thereof. The combination of sensitizing dyes are employed often for the purpose of supersensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GBP Nos. 1,344,281 and 1,507,803, JP-B Nos. 43-4936 and 53-12375, JP-A Nos. 52-110618 and 52-109925.

Along with the sensitizing dye, a material, which does not have spectral sensitizing function itself or does not absorb visible light substantially and exerts supersensitization, may be included in the emulsion.

Time of adding the sensitizing dye to the emulsion may be at any of stages for maturing emulsions that are known to be useful until now. Most ordinarily, it is carried out at a time between the end of chemical sensitization and coating, but addition may be carried out along with adding a chemical sensitization agent to achieve spectral sensitization and chemical sensitization simultaneously as described in U.S. Pat. Nos. 3,628,969 and 4,225,666, or prior to chemical sensitization as described in JP-A No. 58-113928, or prior to the completion of generation of silver halide grain precipitation to initiate spectral sensitization. Furthermore, as taught in U.S. Pat. No. 4,225,666, addition of these compounds in parts, in other words, a part of these compounds is added prior to chemical sensitization and the remaining part is added after the chemical sensitization, is also possible. Starting with the method described in U.S. Pat. No. 4,183,756, the addition may be carried out at any time in the silver halide grain formation. Usable addition amount is from $4\times10^{-6}$ to $8\times10^{-3}$ mol per 1 mol of the silver halide.

In the silver halide photographic photosensitive material according to the invention, a silver halide grain whose grain surface has been fogged as described in U.S. Pat. No. 4,082,553, a silver halide grain whose grain inside has been fogged as described in U.S. Pat. No. 4,626,498 and JP-A 59-214852, and colloidal silver may be employed preferably for a photosensitive silver halide emulsion layer and/or a substantially non-photosensitive hydrophilic colloidal layer. The phrase "silver halide grain whose grain inside or surface has been fogged" means silver halide grains which can be developed uniformly (non-imagewisely) irrespective of an unexposed or exposed portion of the photosensitive material. The method for preparing a silver halide grain whose grain inside or surface has been fogged is described in U.S. Pat. No. 4,626,498 and JP-A No. 59-214852.

A silver halide forming a inside nuclei of a core/shell type silver halide grain whose grain inside has been fogged may have the same or different halogen composition. As the silver halide whose grain inside or surface has been fogged, any of silver chloride, silver chlorobromide, silver iodobromide and silver chloroiodobromide may be usable. Grain size of the fogged silver halide grain is not particularly limited, but an average grain size from 0.01 to 0.75 μm, and from 0.05 to 0.6 μm in particular is preferable. Figure of the grain is also not particularly limited. Regular grains may usable and a polydisperse emulsion may be usable, but a monodispersion (in which at least 95% of silver halide grains by mass or grain number have grain diameters within ±40% of the average grain diameter) is preferable.

In the photosensitive material according to the invention, two or more kinds of photosensitive silver halide emulsions, which have properties different in at least one of grain size, grain size distribution, halogen composition, grain shape and sensitivity, may be used as a mixture in the same layer.

In the manufacturing method for the photographic photosensitive material according to the invention, usually, photographically useful materials are added to a photographic coating liquid, that is, to a hydrophilic colloidal liquid.

The photosensitive material according to the invention is normally treated with an alkaline developing liquid containing a developing agent, normally, after an imagewise exposure. After the color development, the color photographic photosensitive material is subjected to an image formation method in which it is treated with a processing liquid containing a bleaching agent and exerting a bleaching ability.

The silver halide photographic photosensitive material according to the invention may have at least one inter image effect-donating layer in which substantially no image is formed, for the purpose of improving color reproduction.

Any photosensitive emulsion may be used for the inter image effect-donating layer, but the silver iodide content thereof is preferably 6 mol % or more, and more preferably 9 mol % or more. Further, a combination of a photosensitive emulsion and nonphotosensitive fine grain emulsion may be employed for an inter image effect-donating layer preferably. The nonphotosensitive fine grain may be used in the same layer as the photosensitive emulsion, or added to an adjacent layer. A disposing position of the inter image effect-donating layer is not limited, but the donor layer is preferably disposed adjacent to or close to the principal photosensitive layer. The silver iodide content of the nonphotosensitive fine grain emulsion at this time is not limited but 3 mol % or more is preferable, and a silver iodide fine grain may be employed preferably. Here, the grain in the nonphotosensitive fine grain emulsion has a size of 0.15 μm or less, and "nonphotosensitive" means that difference of the sensitivities between the nonphotosensitive emulsion and a photosensitive emulsion being used in combination is substantially 1.5 LogE or more.

Although the spectral sensitivity property of the inter image effect-donating layer is not limited, it is preferable in point of color reproduction to dispose a photosensitive emulsion layer having been spectrally sensitized in cyan region to give an inter image effect to a red light-sensitive emulsion layer. A layer for giving such an inter-image effect may be bleu-sensitive, green light-sensitive or red light-sensitive. It is also preferably used to dispose an inter-image effect-donating layer, such as BL, GL and RL described in U.S. Pat. Nos. 4,663,271, 4,705,744 and 4,707,436, and JP-A Nos. 62-160448 and 63-89850 having a spectral sensitivity distribution different from that of the principal photosensitive layer, adjacent to or close to the principal photosensitive layer.

When the inter image effect-donating layer is used, use of photosensitve emulsions having different sensitivities in combination is preferable. Although sensitivity difference between the photosensitve emulsions is not limited, the difference from 0.1 to 1.0 is preferable. Although number of kinds of the photosensitve emulsions is not limited, a number from 2 to 4 is preferable.

The inter image effect-donating layer of the invention may be constituted of two layers or more as an inter image effect-donating unit. In this case, each of photosensitive emulsion contained in respective layers has a sensitivity different from one another preferably, by from 0.1 to 1.0 preferably. Although a number of layers is not limited, from 2 to 4 layers are preferable.

In the photosensitive material according to the invention, a competitive compound (a compound that reacts with an aromatic primary amine color developing agent oxidized body while competing with an image-forming coupler but forms no dye image) may be used in combination. Examples of the competitive compound include reducing compounds such as hydroquinones, catechols, hydrazines and sulfoneamide phenols, and a compound that couples with an aromatic primary amine color developing principal agent oxidized body but forms substantially no color image (for example, a colorless coupler as described in German Patent No. 1,155,675, GBP No. 861,138, U.S. Pat. Nos. 3,876,428 and 3,912,513, or a releasing coupler as described in JP-A No. 6-83002).

Usable addition amount of the competitive compound is from 0.01 g to 10 g preferably, 0.10 g to 5.0 g more preferably per 1 $m^2$ of the photosensitive material; and from 1 to 1000 mol % preferably, from 20 to 500 mol % more preferably relative to the coupler of the invention.

The photosensitive material according to the invention may have a non-coloring intermediate layer in a photosensitive unit of the same color sensitivities and, further, the intermediate layer is desirably incorporated with a compound selectable as the aforementioned competitive compound.

The photosensitive material according to the invention includes preferably a compound, as described in U.S. Pat. Nos. 4,411,987 and 4,435,503, that can react with formaldehyde gas to stabilize in the photosensitive material, in order to prevent degradation of photographic properties due to formaldehyde gas.

The photosensitive material according to the invention may have at least one blue light-sensitive silver halide emulsion layer, green light-sensitive silver halide emulsion layer and red light-sensitive silver halide emulsion layer respectively on a support and, according to need, at least one inter image effect-donating layer that forms substantially no image; and preferably they are coated so as to be constituted in this order from the side farther to the support, but orders different from this may also be acceptable. In the invention, it is preferable that the red light-sensitive silver halide emulsion layer, the green light-sensitive silver halide emulsion layer and the blue light-sensitive silver halide emulsion layer are coated in this order from the side nearer to the support; that respective color-sensitive layers have a unit constitution including two or more layers of photosensitive emulsion having different sensitivities; and that each of them has a three-layer unit constitution consisting of a low sensitivity layer, a medium sensitivity layer and a high sensitivity layer from the side nearer to the support in particular. These are described in JP-B No. 49-15495, JP-A No. 59-202464 and the like.

Examples of preferable embodiments of the invention include a photosensitive element in which an undercoating layer/an anti-halation layer/a first intermediate layer/a short wave green light-sensitive unit (inter image effect-donating layer 1)/a long wave red light-sensitive unit (inter image effect-donating layer 2)/a second intermediate layer/a red light-sensitive emulsion layer unit (consisting of three layers including a low sensitivity red light-sensitive layer/a medium sensitivity red light-sensitive layer/a high sensitivity red light-sensitive layer from the side nearer to the support)/a third intermediate layer/a green light-sensitive emulsion layer unit (consisting of three layers including a low sensitivity green light-sensitive layer/a medium sensitivity green light-sensitive layer/a high sensitivity green light-sensitive layer from the side nearer to the support)/a yellow filter layer/a short wave blue light-sensitive unit (inter image effect-donating layer 3)/a blue light-sensitive emulsion layer unit (consisting of three layers including a low sensitivity blue light-sensitive layer/a medium sensitivity blue light-sensitive layer/a high sensitivity blue light-sensitive layer from the side nearer to the support)/a first protective layer/a second protective layer are coated in this order on the support, can be mentioned.

Each of the first, second and third intermediate layers may be constituted of a single layer or two or more layers. The first intermediate layer is preferably divided further into two or more layers and the layer that directly adjacent to the red light-sensitive layer includes yellow colloidal silver. Similarly, it is preferable that the third intermediate layer has a constitution of two or more layers and the layer that directly adjacent to the green light-sensitive emulsion layer unit includes yellow colloidal silver. In addition, it is preferable to arrange a fourth intermediate layer between the yellow filter layer and the blue light-sensitive emulsion layer unit. The inter image effect-donating layer itself may contain an anti-color mixing agent.

The intermediate layer may contain a coupler, DIR compound and the like as described in JP-A Nos. 61-43748, 59-113438, 59-113440, 61-20037 and 61-20038, and anti-color mixing agent as is conventionally used.

Further, preference is also given to employing a three-layer constitution for the protective layer, including a first to third protective layers. When the protective layer consists of two or three layers, it is preferable that a second protective layer contains fine grain silver halide, which have an equivalent-sphere average grain diameter of 0.10 μm or less. In that case, it is preferable that the fine grain silver halide consists of silver bromide or silver iodobromide.

EXAMPLES

Hereinafter, the invention will be explained specifically with reference to examples. However, the invention is not intended to be limited to the Examples.

Sample 1

As an example, a result relating to a red light-sensitive emulsion layer unit will be represented. Although results for green light- and blue light-sensitive layer units are not represented here, similar good results were obtained for the constitution according to the invention.

Preparation of an Emulsion Em-1 for a High Sensitivity-emulsion Layer that Contains Silver Halide Grains Having Dislocation Lines 1.0 L of an aqueous gelatin solution containing 1.0% by mass of gelatin and 0.08 M of potassium bromide was added, while stirring, with 42 mL of 0.5 M aqueous silver nitrate solution and 42 mL of 0.5 M aqueous potassium bromide solution, by a double-jet method for 25 seconds. During the period, temperature was kept at 35° C. After the addition, 14 g of gelatin was added thereto, and the temperature was raised to 75° C. Then, 100 mL of 1.0 M aqueous silver nitrate solution was slowly added, and further $NH_4OH$ was added so as to maintain pH of the reaction solution at 9.3 for 20 minutes. After adjusting pH thereof to an original pH of the reaction solution, an aqueous silver nitrate solution containing 103 g of silver nitrate and an aqueous potassium bromide solution were added by an accelerated flow volume (flow volume at the end is 19 times that at the start) for 60 minutes. During that time, pBr of the reaction solution was maintained at 2.35. Next, an aqueous solution containing 2.7 g of potassium iodide was singly added for 90 seconds. Further, an aqueous silver nitrate solution containing 68 g of silver nitrate and an aqueous potassium bromide solution were added over 10 minutes, while maintaining pBr of the reaction solution at 2.55, by increasing a flow volume of the silver nitrate/potassium bromide solutions (the flow volume at the end was 5 times that at the start). Subsequently, the emulsion was desalted with a conventionally-known flocculation method and adjusted to pH 6.5 and pAg 8.5 at 40° C. Further, a temperature of the emulsion was raised to 65° C. Further, the emulsion was added with spectral sensitizing dyes S-1, S-2 and S-3, the structures of which are shown below, at a molar ratio of 86:7:7 so that a sum of the spectral sensitizing dyes shares 81% of the saturated coating amount, left to stand for 15 minutes, and was optimally subjected to chemical sensitization with sodium thiosulfate, potassium aurichlorate and potassium thiocyanate. After the end of the chemical sensitization, tetraazaindene (hereinafter, TAI) was added as a stabilizer. Thus, an emulsion containing grains having a diameter of 0.82 μm in terms of a sphere, a AgI content of 1.6 mol %, an average diameter of projected areas in terms of a circle of 1.24, and an average aspect ratio of 5.1 was obtained.

Preparation of an Emulsion Em-2 for a High Sensitivity-emulsion Layer that Contains Silver Halide Grains Having Dislocation Lines and High Aspect Ratio 1.0 L of an aqueous gelatin solution containing 1.0% by mass of gelatin and 0.08 M of potassium bromide was added, while stirring, with 42 mL of 0.5 M aqueous silver nitrate solution and 42 mL of 0.5 M aqueous potassium bromide solution, by a double-jet method for 25 seconds. During the period, temperature was kept at 35° C. After the addition, 14 g of gelatin was added thereto, and the temperature was raised to 75° C. Then, 100 mL of 1.0 M aqueous silver nitrate solution was slowly added, and further $NH_4OH$ was added so as to maintain pH of the reaction solution at 9.3 for 20 minutes. After adjusting pH thereof to an original pH of the reaction solution, an aqueous silver nitrate solution containing 130 g of silver nitrate and an aqueous potassium bromide solution were added by an accelerated flow volume (flow volume at the end is 19 times that at the start) for 60 minutes. During that time, pBr of the reaction solution was maintained at 2.35. Next, a prepared emulsion containing 3.8 g of silver iodide grains was singly added thereto. Further, an aqueous silver nitrate solution containing 20 g of silver nitrate and an aqueous potassium bromide solution were added over 10 minutes, while maintaining pBr of the reaction solution at 2.55, by increasing a flow volume of the silver nitrate/potassium bromide solutions (the flow volume at the end was 5 times that at the start). Subsequently, the emulsion was desalted with a conventionally-known flocculation method and adjusted to pH 6.5 and pAg 8.5 at 40° C. Further, a temperature of the emulsion was raised to 65° C. Further, the emulsion was added with spectral sensitizing dyes S-1, S-2 and S-3, the structures of which are shown below, at a molar ratio of 86:7:7 so that a sum of the spectral sensitizing dyes shares 83% of the saturated coating amount, left to stand for 15 minutes, and was optimally subjected to chemical sensitization with sodium thiosulfate, potassium aurichlorate and potassium thiocyanate. After the end of the chemical sensitization, TAI was added as a stabilizer. Thus, an emulsion containing grains having a diameter of 0.82 μm in terms of a sphere, a AgI content of 1.6 mol %, an average diameter of projected areas in terms of a circle of 1.64, and an average aspect ratio of 12.0 was obtained.

Preparation of an Emulsion Em-3 for a High Sensitivity-emulsion Layer that Contains Silver Halide Grains Having No Dislocation Line 1.0 L of an aqueous gelatin solution containing 1.0% by mass of gelatin and 0.08 M of potassium bromide was added, while stirring, with 42 mL of 0.5 M aqueous silver nitrate solution and 42 mL of 0.5 M aqueous potassium bromide solution, by a double-jet method for 25 seconds. During the period, temperature was kept at 35° C. After the addition, 14 g of gelatin was added thereto, and the temperature was raised to 75° C. Then, 100 mL of 1.0 M aqueous silver nitrate solution was slowly added, and further $NH_4OH$ was added so as to maintain pH of the reaction solution at 9.3 for 20 minutes. After adjusting pH thereof to an original pH of the reaction solution, an aqueous silver nitrate solution containing 130 g of silver nitrate and an aqueous potassium iodide solution containing 2.7 g of potassium iodide were added by an accelerated flow volume (flow volume at the end is 19 times that at the start) for 60 minutes. During that time, pBr of the reaction solution was maintained at 2.35. Next, an aqueous solution containing 2.7 g of potassium iodide was singly added for 90 seconds. Further, an aqueous silver nitrate solution containing 20 g of silver nitrate and an aqueous potassium bromide solution were added over 10 minutes, while maintaining pBr of the reaction solution at 2.55, by increasing a flow volume of the silver nitrate/potassium bromide solutions (the flow volume at the end was 5 times that at the start). Subsequently, the emulsion was desalted with a conventionally-known flocculation method and adjusted to pH 6.5 and pAg 8.5 at 40° C. Further, a temperature of the emulsion was raised to 65° C. Further, the emulsion was added with spectral sensitizing dyes S-1, S-2 and S-3, the structures of which are shown below, at a molar ratio of 86:7:7 so that a sum of the spectral sensitizing dyes shares 82% of the saturated coating amount, left to stand for 15 minutes, and was optimally subjected to chemical sensitization with sodium thiosulfate, potassium aurichlorate and potassium thiocyanate. After the end of the chemical sensitization, TAI was added as a stabilizer. Thus, an emulsion containing grains having a diameter of 0.82 μm in terms of a sphere, a AgI content of 1.6 mol %, an average diameter of projected areas in terms of a circle of 1.77, and an average aspect ratio of 15.0 was obtained.

Preparation of Emulsion Em-4 for an Internal Latent Image Type High Sensitivity-emulsion Layer that Contains Silver Halide Grains Having No Dislocation Line The same processes were conducted as those in the preparation of the emulsion Em-3 until adding TAI in the chemical maturing. Subsequently, a silver iodobromide fine grain-containing emulsion (equivalent-sphere diameter of the silver iodobromide fine grain: 0.04 μm) containing silver iodide by 1 mol % was added by 7.5 g in terms of silver nitrate, then the reaction solution was maintained at 65° C for 20 minutes. Thus, shells of the grains were formed by Ostwald maturing. The emulsion thus obtained was named Em-4. On the basis of the definition of the surface sensitivity/total development sensitivity in the text, respective sensitivities were obtained for the emulsion Em-4 which revealed that the total development sensitivity was higher than the surface sensitivity by around 26%. In the emulsion Em-4, distinct protrusion as can be seen in emulsion Em-5 to be described below was not confirmed.

Preparation of Emulsion Em-5 for a High Sensitivity-emulsion Layer that Contains Silver Halide Grains Having an Epitaxial and No Dislocation Line 1.0 L of a 1.0% by mass of aqueous gelatin solution containing 0.08 M of potassium bromide was added, while stirring, with 42 mL of 0.5 M aqueous silver nitrate solution and 0.5 M aqueous potassium bromide solution, respectively, by a double-jet method for 25 seconds. During the period, temperature was kept at 35° C. After the addition, 14 g of gelatin was added, and the temperature was raised to 75° C. Then, 100 mL of 1.0 M aqueous silver nitrate solution was added slowly, and further $NH_40H$ was added to maintain pH=9.3 for 20 minutes. After returning the pH to the original value, an aqueous silver nitrate solution containing 130 g of silver nitrate and an aqueous solution containing 2.7 g of potassium iodide were added by an accelerated flow volume (flow volume at the end is 19 times that at the start) for an additional 60 minutes. During that time, pBr was maintained at 2.35. For an additional 10 minutes, an aqueous silver nitrate solution containing 20 g of silver nitrate and an aqueous potassium bromide solution were added, while maintaining pBr at 2.55, by an accelerated flow volume (flow volume at the end is 5 times that at the start). The grain is defined as the host grain. The aforementioned host grain formation process was followed by a process operation below to carry out epitaxial precipitation. The temperature was lowered to 40° C., and an aqueous silver nitrate solution was added to adjust a silver potential to +50 mV. After adding 100 mL of an aqueous calcium nitrate solution with calcium concentration of 2 M, spectral sensitizing dyes S-1, S-2 and S-3 were added at a molar ratio of 86:7:7 by a ratio of 98% relative to the saturated coating amount.

Next, KSCN was added by $2.0\times10^{-3}$ mol per mol of silver of the host grain, followed by adding 100 mL of an aqueous solution containing 7 g of silver nitrate and 100 mL of an aqueous solution containing 4.9 g of potassium bromide and 0.5 mg of $K_2[IrCl_6]$ by a double-jet method for 20 minutes at a constant flow volume to carry out the epitaxial precipitation. At this time, a silver potential was maintained at +100 mV relative to the saturated calomel electrode. Silver volume used for the epitaxial precipitation was 4.4% relative to the host grain. It was desalted by a well known flocculation method at 35° C., added with gelatin, added with 6 mL of an aqueous 2M calcium nitrate solution, and adjusted to pH 5.9 and pAg 7.3 at 50° C. The emulsion was maintained at 50°

C., to which $1.9\times10^{-5}$ mol of aurichloric acid (AUTP) per 1 mol of silver of the whole grain, $3.6\times10^{-5}$ mol of sodium thiosulfate (TSAN) per 1 mol of silver of the whole grain, and $6.3\times10^{-6}$ mol of N,N-dimethylselenourea (DMSEU) per 1 mol of silver of the whole grain were added to perform chemical sensitization optimally, followed by adding $3.0\times10^{-4}$ mol of the aforementioned compound A-1 per 1 mol of silver of the whole grain to finish the chemical sensitization process.

In the emulsion thus obtained, silver halide grains, which included a host grain constituted of a silver iodobromide tabular grain with an average silver iodide content of 1.6 mol % having an average equivalent-circle diameter of 1.77 μm, an average thickness of 0.118 μm, a (111) plane with an average aspect ratio of 15.0 as the principal plane and a protrusion mainly formed at the tip of the host grain accounted for 89% of the total projected areas. An average halogen composition of the protrusion was as follows; silver iodide content: silver bromide content: silver chloride content=0.5:99.5:0 (mol %).

On the basis of the definition of the surface sensitivity/total development sensitivity in the text, respective sensitivities were obtained for the emulsion Em-5, which revealed that the total development sensitivity was higher than the surface sensitivity by around 7%.

Preparation of Emulsion Em-6 for High Sensitivity-emulsion Layer that Contains Silver Halide Grains Having an Epitaxial and No Dislocation Line Emulsion Em-6 was prepared in the same manner as described for the emulsion Em-5 except that the silver amount used for the epitaxial precipitation was changed to 2% relative to the host grain. On the basis of the definition of the surface sensitivity/total development sensitivity in the text, respective sensitivities were obtained for the emulsion Em-6, which revealed that the total development sensitivity was equivalent to the surface sensitivity.

Preparation of Emulsion Em-7 for a Medium Sensitivity-emulsion Layer that Contains Silver Halide Grains Having Dislocation Lines 1.5 L of an aqueous solution containing 6.3 g of KBr and 10.0 g of gelatin with an average molecular weight (M) of 15,000 at 52° C. was added, while stirring, with 79 mL of an aqueous silver nitrate solution (containing 31.3 g of silver nitrate in 100 mL) and an aqueous potassium bromide solution (containing 22.8 g of potassium bromide in 100 mL), respectively, by a double-jet method at a rate of 47.2 mL/min, simultaneously. After adding an aqueous gelatin solution (containing 40.4 g of an inert gelatin and 300 mL of water), the temperature was raised to 75° C., an aqueous potassium bromide solution (containing 4.1 g of potassium bromide) was added for 30 seconds, an aqueous solution of ammonium nitrate (containing 21 g of ammonium nitrate) was added, and pH was adjusted to 6.5 by using an aqueous sodium hydroxide solution to mature for 15 minutes, to which acetic acid was added to adjust the pH to 5.3. Subsequently, an aqueous silver nitrate solution (G) containing 50.7 g of silver nitrate and an aqueous potassium bromide solution were added for 15 minutes. At this time, the pAg was maintained at 7.9. After lowering the temperature to 50° C., an aqueous silver nitrate (4.5 g) solution and an aqueous potassium iodide (4.45 g) solution (H) were added by a double-jet, followed by adding an aqueous silver nitrate solution (I) containing 103 g of silver nitrate and an aqueous potassium bromide solution while maintaining the pAg at 8.8. Then, the system was cooled to 35° C., water-washed by a conventionally-known method, added with 70 g of gelatin and adjusted to pH 6.1 and pAg 8.8. The obtained emulsion contained tabular grains with an average equivalent-circle diameter of 0.81 μm, an average thickness of 0.20 μm, an aspect ratio of 4.1 and an average silver iodide content of 2.5 mol %. After raising the temperature of the emulsion thus obtained to 65° C., spectral sensitizing dyes S-1, S-2 and S-3, which are listed below, were added at a mol ratio of 86:7:7 and a ratio of 82% relative to the saturated coating amount and left to stand for 15 minutes, followed by adding $1.1\times10^{-5}$ mol/mol Ag of sodium thiosulfate, $6.4\times10^{-4}$ mol/mol Ag of potassium thiocyanate, and $2.0\times10^{-6}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, TAI was added as a stabilizing agent. The emulsion thus obtained is named Em-7.

Preparation of Emulsion Em-8 for a Medium Sensitivity-emulsion Layer that Contains Silver Halide Grains Having Dislocation Lines and a High Aspect Ratio 1.5 L of an aqueous solution containing 6.3 g of KBr and 10.0 g of gelatin with an average molecular weight (M) of 15,000 at 52° C. was added, while stirring, with 79 mL of an aqueous silver nitrate solution (containing 31.3 g of silver nitrate in 100 mL) and an aqueous potassium bromide solution (containing 22.8 g of potassium bromide in 100 mL), respectively, by a double-jet method at a rate of 47.2 mL/min, simultaneously. After adding an aqueous gelatin solution (containing 40.4 g of an inert gelatin and 300 mL of water), the temperature was raised to 75° C., an aqueous potassium bromide solution (containing 4.1 g of potassium bromide) was added for 30 seconds, an aqueous solution of ammonium nitrate (containing 21 g of ammonium nitrate) was added, and pH was adjusted to 6.5 by using an aqueous sodium hydroxide solution to mature for 15 minutes, to which acetic acid was added to adjust the pH to 5.3. Subsequently, an aqueous silver nitrate solution (G) containing 117 g of silver nitrate and an aqueous potassium bromide solution were added for 15 minutes. At this time, the pAg was maintained at 7.9. After lowering the temperature to 50° C., a prepared emulsion containing 6.3 g of silver iodide grains were added, followed by adding an aqueous silver nitrate solution (I) containing 37 g of silver nitrate and an aqueous potassium bromide solution while maintaining the pAg at 8.8. Then, the system was cooled to 35° C., water-washed by a conventionally-known method, added with 70 g of gelatin and adjusted to pH 6.1 and pAg 8.8. The obtained emulsion contained tabular grains with an average equivalent-circle diameter of 1.0 μm, an average thickness of 0.10 μm, an aspect ratio of 10.0 and an average silver iodide content of 2.5 mol %. After raising the temperature of the emulsion thus obtained to 65° C., spectral sensitizing dyes S-1, S-2 and S-3, which are listed below, were added at a mol ratio of 86:7:7 and a ratio of 83% relative to the saturated coating amount and left to stand for 15 minutes, followed by adding $1.6\times10^{-5}$ mol/mol Ag of sodium thiosulfate, $9.4\times10^{-4}$ mol/mol Ag of potassium thiocyanate, and $2.9\times10^{-6}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, TAI was added as a stabilizing agent. The emulsion thus obtained is named Em-8.

Preparation of Emulsion Em-9 for a Medium Sensitivity-emulsion Layer that Contains Silver Halide Grains Having No Dislocation Line 1.5 L of an aqueous solution containing 6.3 g of KBr and 10.0 g of gelatin with an average molecular weight (M) of 15,000 at 52° C. was added, while stirring, with 79 mL of an aqueous silver nitrate solution (containing 31.3 g of silver nitrate in 100 mL) and an aqueous potassium bromide solution (containing 22.8 g of potassium bromide in 100 mL), respectively, by a double-jet method at a rate of 47.2 mL/min, simultaneously. After adding an aqueous gelatin solution (containing 40.4 g of an inert gelatin and 300 mL of water), the temperature was raised to 75° C., an aqueous potassium bromide solution (containing 4.1 g of potassium bromide) was added for 30 seconds, an aqueous solution of ammonium nitrate (containing 21 g of ammonium nitrate) was added, and pH was adjusted to 6.5 by using an aqueous sodium hydroxide solution to mature for 15 minutes, to which acetic acid was added to adjust the pH to 5.3. Subsequently, an aqueous silver nitrate solution (G) containing 50.7 g of silver nitrate and an aqueous potassium bromide solution were added for 15 minutes. At this time, the pAg was maintained at 7.9. After lowering the temperature to 50° C., an aqueous silver nitrate solution containing 29.0 g of silver nitrate and an aqueous solution (J) containing 3.1 g of potassium iodide and 20.0 g of potassium bromide were added by a double-jet while maintaining the pAg at 8.8, followed by adding an aqueous silver nitrate solution (K) containing 78.4 g of silver nitrate and an aqueous potassium bromide solution while maintaining the pAg at 8.8. Then, the system was cooled to 35° C., water-washed by a conventionally-known method, added with 70 g of gelatin and adjusted to pH 6.1 and pAg 8.8. The obtained emulsion contained tabular grains with an average equivalent-circle diameter of 1.19 μm, an average thickness of 0.09 μm, an aspect ratio of 13.2 and an average silver iodide content of 1.6 mol %. After raising the temperature of the emulsion thus obtained to 65° C., spectral sensitizing dyes S-1, S-2 and S-3, which are listed below, were added at a mol ratio of 86:7:7 and a ratio of 81% relative to the saturated coating amount and left to stand for 15 minutes, followed by adding $5.3\times10^{-5}$ mol/mol Ag of sodium thiosulfate, $6.4\times10^{-4}$ mol/mol Ag of potassium thiocyanate, and $9\times10^{-6}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, TAI was added as a stabilizing agent. The emulsion thus obtained is named Em-9.

Preparation of Emulsion Em-10 for an Internal Latent Image Type Medium Sensitivity-emulsion Layer that Contains Silver Halide grains Having No Dislocation Line The same processes were conducted as those in the preparation of the emulsion Em-9 until adding TAI in the chemical maturing. Subsequently, a silver iodobromide fine grain-containing emulsion (equivalent-sphere diameter of the silver iodobromide fine grain: 0.04 μm) containing silver iodide by 1 mol % was added by 8 g in terms of silver nitrate, then the reaction solution was maintained at 65° C. for 20 minutes. Thus, shells of the grains were formed by Ostwald maturing. The emulsion thus obtained was named Em-10. On the basis of the definition of the surface sensitivity/total development sensitivity in the text, respective sensitivities were obtained for the emulsion Em-10 which revealed that the total development sensitivity was higher than the surface sensitivity by around 27%. In the emulsion Em-10, distinct protrusion as can be seen in emulsion Em-11 to be described below was not confirmed.

Preparation of Emulsion Em-11 for a Medium Sensitivity-emulsion Layer that Contains Silver Halide Grains Having an Epitaxial and No Dislocation Line 1.5 L of an aqueous solution containing 6.3 g of KBr and 10.0 g of gelatin with an average molecular weight (M) of 15,000 at 52° C. was added, while stirring, with 79 mL of an aqueous silver nitrate solution (containing 31.3 g of silver nitrate in 100 mL) and an aqueous potassium bromide solution (containing 22.8 g of potassium bromide in 100 mL), respectively, by a double-jet method at a rate of 47.2 mL/min, simultaneously. After adding an aqueous gelatin solution (containing 40.4 g of an inert gelatin and 300 mL of water), the temperature was raised to 75° C., an aqueous potassium bromide solution (containing 4.1 g of potassium bromide) was added for 30 seconds, an aqueous solution of ammonium nitrate (containing 21 g of ammonium nitrate) was added, and pH was adjusted to 6.5 by using an aqueous sodium hydroxide solution to mature for 15 minutes, to which acetic acid was added to adjust the pH to 5.3. Subsequently, an aqueous silver nitrate solution (G) containing 50.7 g of silver nitrate and an aqueous potassium bromide solution were added for 15 minutes. At this time, the pAg was maintained at 7.9. After lowering the temperature to 50° C., an aqueous solution containing 29.0 g of silver nitrate and an aqueous solution (J) containing 3.1 g of potassium iodide and 20.0 g of potassium bromide were added by a double-jet while maintaining the pAg at 8.8, followed by adding an aqueous silver nitrate solution (K) containing 78.4 g of silver nitrate and an aqueous potassium bromide solution while maintaining the pAg at 8.8. The grain is defined as the host grain. The aforementioned host grain formation process was followed by a process operation below to carry out epitaxial precipitation. The temperature was lowered to 40° C., and an aqueous silver nitrate solution was added to adjust a silver potential to +50 mV. After adding 100 mL of an aqueous calcium nitrate solution with calcium concentration of 2 M, spectral sensitizing dyes S-1, S-2 and S-3 were added at a molar ratio of 86:7:7 by a ratio of 98% relative to the saturated coating amount.

Next, KSCN was added by $2.0\times10^{-3}$ mol per mol of silver of the host grain, followed by adding 100 mL of an aqueous solution containing 7 g of silver nitrate and 100 mL of an aqueous solution containing 4.9 g of potassium bromide and 0.5 mg of $K_2[IrCl_6]$ by a double-jet method for 20 minutes at a constant flow volume to carry out the epitaxial precipitation. At this time, a silver potential was maintained at +100 mV relative to the saturated calomel electrode. Silver volume used for the epitaxial precipitation was 4.4% relative to the host grain. It was desalted by a well known flocculation method at 35° C., added with gelatin, added with 6 mL of an aqueous 2M calcium nitrate solution, and adjusted to pH 5.9 and pAg 7.3 at 50° C. The emulsion was maintained at 50° C., to which $1.9\times10^{-5}$ mol of aurichloric acid (AUTP) per 1 mol of silver of the whole grain, $3.6\times10^{-5}$ mol of sodium thiosulfate (TSAN) per 1 mol of silver of the whole grain, and $6.3\times10^{-6}$ mol of N,N-dimethylselenourea (DMSEU) per 1 mol of silver of the whole grain were added to perform chemical sensitization optimally, followed by adding $3.0\times10^{-4}$ mol of the aforementioned compound A-1 per 1 mol of silver of the whole grain to finish the chemical sensitization process.

In the emulsion thus obtained, silver halide grains, which included a host grain constituted of a silver iodobromide tabular grain with an average silver iodide content of 1.6 mol % having an average equivalent-circle diameter of 1.19 μm, an average thickness of 0.09 μm, a (111) plane with an average aspect ratio of 13.2 as the principal plane and a protrusion mainly formed at the tip of the host grain accounted for 88% of the total projected areas. An average halogen composition of the protrusion was as follows; silver iodide content: silver bromide content: silver chloride content=0.5:99.5:0 (mol %).

On the basis of the definition of the surface sensitivity/total development sensitivity in the text, respective sensitivities were obtained for the emulsion Em-11, which revealed that the total development sensitivity was higher than the surface sensitivity by around 7%.

Preparation of Emulsion Em-12 for Medium Sensitivity-emulsion Layer that Contains Silver Halide Grains Having an Epitaxial and No Dislocation Line Emulsion Em-12 was prepared in the same manner as described for the emulsion Em-11 except that the silver amount used for the epitaxial precipitation was changed to 2% relative to the host grain. On the basis of the definition of the surface sensitivity/total development sensitivity in the text, respective sensitivities were obtained for the emulsion Em-12, which revealed that the total development sensitivity was equivalent to the surface sensitivity.

Preparation of emulsion Em-13 for Medium Sensitivity-emulsion Layer that Contains Silver Halide Grains Having an Epitaxial and No Dislocation Line Emulsion Em-13 was prepared in the same manner as described for the emulsion Em-11 except that the silver amount used for the epitaxial precipitation was changed to 14% relative to the host grain. On the basis of the definition of the surface sensitivity/total development sensitivity in the text, respective sensitivities were obtained for the emulsion Em-13, which revealed that the total development sensitivity was equivalent to the surface sensitivity.

Preparation of Emulsion Em-14 for a Lowest Sensitivity-emulsion Layer that Contains Silver Halide Grains having Dislocation Lines 1.6 L of an aqueous solution containing 4.3 g of KBr and 7.5 g of gelatin with an average molecular weight (M) of 20,000 at 40° C. was added, while stirring, with 41 mL of an aqueous silver nitrate solution (containing 20.48 g of silver nitrate in 100 mL) and 41 mL of an aqueous potassium bromide-potassium iodide solution (containing 14.3 g of potassium bromide and 2.7 g of potassium iodide in 100 mL), respectively, by a double-jet method at a rate of 61.5 mL/min, simultaneously. After adding an aqueous gelatin solution (containing 35.6 g of an inert gelatin and 284 mL of water), the temperature was raised to 58° C., an aqueous potassium nitrate solution (containing 2.4 g of potassium nitrate) was added for 30 seconds to mature for 15 minutes. $2\times10^{-5}$ mol/mol total Ag of thiourea dioxide was added thereto so as to introduce hole trap zones, and subsequently, an aqueous silver nitrate solution (A) containing 47 g of silver nitrate and an aqueous potassium bromide solution were added for 20 minutes. At this time, the pAg was maintained at 8.7. After lowering the temperature to 40° C., an aqueous silver nitrate (8.6 g) solution and an aqueous potassium iodide (8.5 g) solution (C) were added by a double-jet, followed by adding an aqueous silver nitrate solution (B) containing 164 g of silver nitrate and an aqueous potassium bromide solution while maintaining the pAg at 9.2. Then, the system was cooled to 35° C., water-washed by a conventionally-known method, added with 77 g of gelatin and adjusted to pH 6.2 and pAg 8.8. The obtained emulsion contained tabular grains with an average equivalent-circle diameter of 0.35 μm, an average thickness of 0.15 μm, an aspect ratio of 2.3 and an average silver iodide content of 4.3 mol %. After raising the temperature of the emulsion thus obtained to 62° C., spectral sensitizing dyes S-1, S-2 and S-3, which are listed below, were added at a mol ratio of 86:7:7 and a ratio of 82% relative to the saturated coating amount and left to stand for 10 minutes, followed by adding $2.6\times10^{-5}$ mol/mol Ag of sodium thiosulfate, $1.1\times10^{-5}$ mol/mol Ag of N,N-dimethylselenourea, $3.0\times10^{-3}$ mol/mol Ag of potassium thiocyanate, and $8.6\times10^{-6}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, $5\times10^{-4}$ mol/mol Ag of TAI was added as a stabilizing agent. The emulsion thus obtained is named Em-14.

Preparation of Emulsion Em-15 for a Lowest Sensitivity-emulsion Layer that Contains Silver Halide Grains Having Dislocation Lines and a High Aspect Ratio 1.6 L of an aqueous solution containing 4.3 g of KBr and 7.5 g of gelatin with an average molecular weight (M) of 20,000 at 40° C. was added, while stirring, with 41 mL of an aqueous silver nitrate solution (containing 20.48 g of silver nitrate in 100 mL) and 41 mL of an aqueous potassium bromide-potassium iodide solution (containing 14.3 g of potassium bromide and 2.7 g of potassium iodide in 100 mL), respectively, by a double-jet method at a rate of 61.5 mL/min, simultaneously. After adding an aqueous gelatin solution (containing 35.6 g of an inert gelatin and 284 mL of water), the temperature was raised to 58° C., an aqueous potassium nitrate solution (containing 2.4 g of potassium nitrate) was added for 30 seconds to mature for 15 minutes. $2\times10^{-5}$ mol/mol total Ag of thiourea dioxide was added thereto so as to introduce hole trap zones, and subsequently, an aqueous silver nitrate solution (A) containing 154 g of silver nitrate and an aqueous potassium bromide solution were added for 20 minutes. At this time, the pAg was maintained at 8.7. After lowering the temperature to 40° C., a prepared emulsion containing 12 g of silver iodide grains were added, followed by adding an aqueous silver nitrate solution (B) containing 57 g of silver nitrate and an aqueous potassium bromide solution while maintaining the pAg at 9.2. Then, the system was cooled to 35° C., water-washed by a conventionally-known method, added with 77 g of gelatin and adjusted to pH 6.2 and pAg 8.8. The obtained emulsion contained tabular grains with an average equivalent-circle diameter of 0.6 μm, an average thickness of 0.08 μm, an aspect ratio of 8 and an average silver iodide content of 4.3 mol %. After raising the temperature of the emulsion thus obtained to 62° C., spectral sensitizing dyes S-1, S-2 and S-3, which are listed below, were added at a mol ratio of 86:7:7 and a ratio of 83% relative to the saturated coating amount and left to stand for 10 minutes, followed by adding $4.6\times10^{-5}$ mol/mol Ag of sodium thiosulfate, $2.5\times10^{-5}$ mol/mol Ag of N,N-demethylselenourea, $4.6\times10^{-3}$ mol/mol Ag of potassium thiocyanate, and $1.4\times10^{-5}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, $7.7\times10^{-4}$ mol/mol Ag of TAI was added as a stabilizing agent. The emulsion thus obtained is named Em-15.

Preparation of Emulsion Em-16 for a Lowest Sensitivity-emulsion Layer that Contains Silver Halide Grains Having Dislocation Lines 1.6 L of an aqueous solution containing 4.3 g of KBr and 7.5 g of gelatin with an average molecular weight (M) of 20,000 at 40° C. was added, while stirring, with 41 mL of an aqueous silver nitrate solution (containing 20.48 g of silver nitrate in 100 mL) and 41 mL of an aqueous potassium bromide-potassium iodide solution (containing 14.3 g of potassium bromide and 2.7 g of potassium iodide in 100 mL), respectively, by a double-jet method at a rate of 61.5 mL/min, simultaneously. After adding an aqueous gelatin solution (containing 35.6 g of an inert gelatin and 284 mL of water), the temperature was raised to 58° C., an aqueous potassium nitrate solution (containing 2.4 g of potassium nitrate) was added for 30 seconds to mature for 15 minutes. $2\times10^{-5}$ mol/mol total Ag of thiourea dioxide was added thereto so as to introduce hole trap zones, and subsequently, an aqueous silver nitrate solution (A) containing 47 g of silver nitrate and an aqueous potassium bromide solution were added for 20 minutes. At this time, the pAg was maintained at 8.7. After lowering the temperature to 40° C., an aqueous silver nitrate solution (D) containing 87 g of silver nitrate and an aqueous solution (E) containing 60.3 g of potassium iodide and 9.35 g of potassium iodide were added by a double-jet while maintaining the pAg at 9.7, followed by adding an aqueous silver nitrate solution (F) containing 85.6 g of silver nitrate and an aqueous potassium bromide solution while maintaining the pAg at 9.2. Then, the system was cooled to 35° C., water-washed by a conventionally-known method, added with 77 g of gelatin and adjusted to pH 6.2 and pAg 8.8. The obtained emulsion contained tabular grains with an average equivalent-circle diameter of 0.61 μm, an average thickness of 0.05 μm, an aspect ratio of 12.2 and an average silver iodide content of 4.3 mol %. After raising the temperature of the emulsion thus obtained to 62° C., spectral sensitizing dyes S-1, S-2 and S-3, which are listed below, were added at a mol ratio of 86:7:7 and a ratio of 82% relative to the saturated coating amount and left to stand for 10 minutes, followed by adding $9.5\times10^{-5}$ mol/mol Ag of sodium thiosulfate, $4.0\times10^{-5}$ mol/mol Ag of N,N-dimethylselenourea, $3.0\times10^{-3}$ mol/mol Ag of potassium thiocyanate, and $34.4\times10^{-6}$ mol/mol Ag of aurichloric acid. The amount of the sensitizing dye, the amount of the chemical sensitization agent and time period of the chemical maturing were determined so that sensitivity at exposure of 1/100 second became the highest. After the end of the chemical maturing, TAI was added as a stabilizing agent. The emulsion thus obtained is named Em-16.

Preparation of Emulsion Em-17 for a Lowest Sensitivity-emulsion Layer that Contains Silver Halide Grains Having No Dislocation Line The same processes were conducted as those in the preparation of the emulsion Em-10 until adding TAI in the chemical maturing. Subsequently, a silver iodobromide fine grain-containing emulsion (equivalent-sphere diameter of the silver iodobromide fine grain: 0.04 μm) containing silver iodide by 1 mol % was added by 11 g in terms of silver nitrate, then the reaction solution was maintained at 62° C. for 20 minutes. Thus, shells of the grains were formed by Ostwald maturing. The emulsion thus obtained was named Em-17. In the emulsion Em-17, distinct protrusion as can be seen in emulsion Em-18 to be described below was not confirmed.

Preparation of Emulsion Em-18 for a Lowest Sensitivity-emulsion Layer that Contains Silver Halide Grains Having No Dislocation Line 1.6 L of an aqueous solution containing 4.3 g of KBr and 7.5 g of gelatin with an average molecular weight (M) of 20,000 at 40° C. was added, while stirring, with 41 mL of an aqueous silver nitrate solution (containing 20.48 g of silver nitrate in 100 mL) and 41 mL of an aqueous potassium bromide-potassium iodide solution (containing 14.3 g of potassium bromide and 2.7 g of potassium iodide in 100 mL), respectively, by a double-jet method at a rate of 61.5 mL/min, simultaneously. After adding an aqueous gelatin solution (containing 35.6 g of an inert gelatin and 284 mL of water), the temperature was raised to 58° C., an aqueous potassium nitrate solution (containing 2.4 g of potassium nitrate) was added for 30 seconds to mature for 15 minutes. $2\times10^{-5}$ mol/mol total Ag of thiourea dioxide was added thereto so as to introduce hole trap zones, and subsequently, an aqueous silver nitrate solution (A) containing 47 g of silver nitrate and an aqueous potassium bromide solution were added for 20 minutes. At this time, the pAg was maintained at 8.7. After lowering the temperature to 40° C., an aqueous silver nitrate solution (D) containing 87 g of silver nitrate and an aqueous solution (E) containing 60.3 g of potassium iodide and 9.35 g of potassium iodide were added by a double-jet while maintaining the pAg at 9.7, followed by adding an aqueous silver nitrate solution (F) containing 85.6 g of silver nitrate and an aqueous potassium bromide solution while maintaining the pAg at 9.2. The grain is defined as the host grain. The aforementioned host grain formation process was followed by a process operation below to carry out epitaxial precipitation. The temperature was lowered to 40° C., and an aqueous silver nitrate solution was added to adjust a silver potential to +50 mV. After adding 100 mL of an aqueous calcium nitrate solution with calcium concentration of 2 M, spectral sensitizing dyes S-1, S-2 and S-3 were added at a molar ratio of 86:7:7 by a ratio of 98% relative to the saturated coating amount.

Next, KSCN was added by $2.0\times10^{31\ 3}$ mol per mol of silver of the host grain, followed by adding 100 mL of an aqueous solution containing 7 g of silver nitrate and 100 mL of an aqueous solution containing 4.9 g of potassium bromide and 0.5 mg of $K_2[IrCl_6]$ by a double-jet method for 20 minutes at a constant flow volume to carry out the epitaxial precipitation. At this time, a silver potential was maintained at +100 mV relative to the saturated calomel electrode. Silver volume used for the epitaxial precipitation was 4.4% relative to the host grain. It was desalted by a well known flocculation method at 35° C., added with gelatin, added with 6 mL of an aqueous 2M calcium nitrate solution, and adjusted to pH 5.9 and pAg 7.3 at 50° C. The emulsion was maintained at 50° C., to which $1.9\times10^{-5}$ mol of aurichloric acid (AUTP) per 1 mol of silver of the whole grain, $3.6\times10^{-5}$ mol of sodium thiosulfate (TSAN) per 1 mol of silver of the whole grain, and $6.3\times10^{-6}$ mol of N,N-dimethylselenourea (DMSEU) per 1 mol of silver of the whole grain were added to perform chemical sensitization optimally, followed by adding $3.0\times10^{-4}$ mol of the aforementioned compound A-1 per 1 mol of silver of the whole grain to finish the chemical sensitization process.

In the emulsion thus obtained, silver halide grains, which included a host grain constituted of a silver iodobromide tabular grain with an average silver iodide content of 4.3 mol % having an average equivalent-circle diameter of 0.61 μm, an average thickness of 0.05 μm, a (111) plane with an average aspect ratio of 12.2 as the principal plane and a protrusion mainly formed at the tip of the host grain accounted for 89% of the total projected areas. An average halogen composition of the protrusion was as follows; silver iodide content: silver bromide content: silver chloride content=1.5:98.5:0 (mol %).

On the basis of the definition of the surface sensitivity/total development sensitivity in the text, respective sensitivities were obtained for the emulsion Em-18, which revealed that the total development sensitivity was higher than the surface sensitivity by around 7%.

Preparation of Emulsion Em-19 for a High Sensitivity-emulsion Layer that Contains Silver Halide Grains Having an Epitaxial and No Dislocation Line Emulsion Em-19 was prepared in the same manner as described for the emulsion Em-18 except that the silver amount used for the epitaxial precipitation was changed to 2% relative to the host grain. On the basis of the definition of the surface sensitivity/total development sensitivity in the text, respective sensitivities were obtained for the emulsion Em-19, which revealed that the total development sensitivity was equivalent to the surface sensitivity.

Preparation of Emulsion Em-20 for a Medium Sensitivity-emulsion Layer that Contains Silver Halide Grains Having an Epitaxial and No Dislocation Line Emulsion Em-20 was prepared in the same manner as described for the emulsion Em-18 except that the silver amount used for the epitaxial precipitation was changed to 10% relative to the host grain. On the basis of the definition of the surface sensitivity/total development sensitivity in the text, respective sensitivities were obtained for the emulsion Em-20, which revealed that the total development sensitivity was about 12% higher than the surface sensitivity.

Preparation of Emulsion Em-21 for a Lowest Sensitivity-emulsion Layer that Contains Silver Halide Grains Having an Epitaxial and a Few Dislocation Lines The host grains of Emulsion Em-21 were prepared in the same manner as described for the emulsion Em-15 except that the amount of silver iodide grains was changed to 4 g and the aqueous potassium bromide solution used in the growth before the addition of grains were changed to an aqueous potassium bromide solution containing 5.7 g of potassium bromide. Thus obtained emulsion contained tabular grains (host grains) had an average silver iodide content of 4.3 mol % having an average equivalent-circle diameter of 0.56 μm, an average thickness of 0.06 μm, an aspect ratio of 10. Thus obtained host grains were treated in the same manner as described for the emulsion Em-19 to conduct an epitaxial precipitation to obtain the emulsion Em-21. On the basis of the definition of the surface sensitivity/total development sensitivity in the text, respective sensitivities were obtained for the emulsion Em-21, which revealed that the total development sensitivity was about 7% higher than the surface sensitivity.

Evaluation of Dislocation Line

Dislocation lines of silver halide grains contained in the emulsions Em-1 to 21 were directly observed by using a transmission electron microscope according to the method described in Example 1-(2) of JP-A No. 63-220238. As the result, for the emulsions Em-1, 2, 7, 8, 14 and 15, many dislocation lines (more than 10 lines) were observed for over 80% of grains in number; for the emulsion Em-21, a small number of dislocation lines (less than 10 lines) were confirmed; and for remaining emulsions, no dislocation line was observed for most of grains, that lead the conclusion of the evaluation that the remaining emulsions included substantially no dislocation line.

According to the following method, multilayer color photographic photosensitive materials were prepared.

Preparation of Example 101

(1) Manufacture of Triacetylcellulose Film (Support)

A triacetylcellulose film was manufactured by using a banding method based on a conventionally-known casting method, by dissolving triacetylcellulose in dichloromethane/methanol=92/8(mass ratio) so that 13% by mass of triacetylcellulose is contained, and adding triphenyl phosphate and biphenyldiphenyl phosphate as plastisizers in a mass ratio of 2:1 so that the sum of them became 14% relative to the amount of triacetylcellulose. Thickness of a thus-obtained support after drying was 97 μm.

(2) Content of an Undercoating Layer

Both surface sides of the triacetylcellulose film were provided with a following undercoating layer. Numerals represent mass contained in 1.0 L of a liquid for undercoating layer.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water | fill up to 1 L |

(3) Coating of a Back Layer

On one side of the support thus provided with an undercoating, a back layer shown bellow was coated.

| | |
|---|---|
| **First layer** | |
| Binder: acid-treated gelatin (isoelectric point 9.0) | 1.00 g |
| Polymer latex P-2(average grain diameter: 0.1 μm) | 0.13 g |
| Polymer latex: P-4(average grain diameter: 0.2 μm) | 0.23 g |
| Ultraviolet absorbing agent U-1 | 0.030 g |
| Ultraviolet absorbing agent U-2 | 0.010 g |
| Ultraviolet absorbing agent U-3 | 0.010 g |
| Ultraviolet absorbing agent U-4 | 0.020 g |
| High boiling point organic solvent Oil-2 | 0.030 g |
| Surfactant W-2 | 0.010 g |
| Surfactant W-4 | 3.0 mg |
| **Second layer** | |
| Binder: acid-treated gelatin (isoelectric point 9.0) | 3.10 g |
| Polymer latex: P-4 (average grain diameter 0.2 μm) | 0.11 g |
| Ultraviolet absorbing agent U-1 | 0.030 g |
| Ultraviolet absorbing agent U-3 | 0.010 g |
| Ultraviolet absorbing agent U-4 | 0.020 g |
| High boiling point organic solvent Oil-2 | 0.030 g |
| Surfactant W-2 | 0.010 g |
| Surfactant W-4 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| **Third layer** | |
| Binder: acid-treated gelatin (isoelectric point: 9.0) | 3.30 g |
| Surfactant W-2 | 0.020 g |
| Potassium sulfate | 0.30 g |
| Sodium hydroxide | 0.03 g |
| **Fourth layer** | |
| Binder: lime-processed gelatin (isoelectric point 5.4) | 1.15 g |
| Copolymer of methacrylic acid and methylmethacrylate by a molar ratio of 1:9 (average grain diameter 2.0 μm) | 0.040 g |
| Copolymer of methacrylic acid and methylmethacrylate by a molar ratio of 6:4 (average grain diameter 2.0 μm) | 0.030 g |

-continued

| | |
|---|---|
| Surfactant W-2 | 0.060 g |
| Surfactant W-1 | 7.0 mg |
| Hardening agent H-1 | 0.23 g |

(4) Coating of Photosensitive Emulsion Layers

On the opposite side to the side which is coated with the back layer, a photosensitive emulsion layer shown below was coated to provide Example 101. Numerals represent an addition amount per $m^2$. Here, effect of the added compounds is not limited to the described intended use.

As for the gelatin represented below, a gelatin with a molecular weight (mass average molecular weight) from 100,000 to 200,000 was employed. Contents of main metal ions were from 2500 to 3000 ppm for calcium, from 1 to 7 ppm for iron and from 1500 to 3000 ppm for sodium. Further, a gelatin that has a calcium content of less than 1000 ppm was additionally used.

As for respective layers, organic compounds to be incorporated were prepared as an emulsion dispersion (W-2, W-3 and W-4 were used as surfactants) containing gelatin, each photosensitve emulsion and yellow colloidal silver was also prepared as a gelatin dispersion respectively, and they were mixed to prepare a coating liquid so as to provide a described addition amount to serve for coating. Cpd-H, O, P and Q, Dyes D-1,2,3,5,6,8,9 and 10, H-1, P-3, and F-1 to 9 were dissolved in water or an appropriate water-miscible solvent such as methanol, dimethylformamide, ethanol or dimethylacetamide and added to a coating liquid for respective layers.

Concentrations of gelatin in respective layers thus prepared (mass of gelatin solid content/volume of a coating liquid) were in a range from 2.5% to 15.0%, pH of respective coating liquids was in a range from 5.0 to 8.5, and, in coating liquids for layers containing a silver halide emulsion, a value of pAg was in a range from 7.0 to 9.5 when pH and temperature thereof were adjusted to 6.0 and 40° C., respectively.

After coating, drying was conducted by a multi-stage drying process in which temperatures were maintained in a range from 10° C. to 45° C. to provide Examples.

| | |
|---|---|
| **First layer: anti-halation layer** | |
| Black colloidal silver | 0.20 g |
| Gelatin | 2.20 g |
| Compound Cpd-B | 0.010 g |
| Ultraviolet absorbing agent U-1 | 0.050 g |
| Ultraviolet absorbing agent U-3 | 0.020 g |
| Ultraviolet absorbing agent U-4 | 0.020 g |
| Ultraviolet absorbing agent U-5 | 0.010 g |
| Ultraviolet absorbing agent U-2 | 0.070 g |
| Compound Cpd-F | 0.20 g |
| High boiling point organic solvent Oil-2 | 0.020 g |
| High boiling point organic solvent Oil-6 | 0.020 g |
| Dye D-4 | 1.0 mg |
| Dye D-8 | 1.0 mg |
| Fine crystal solid dispersion of dye E-1 | 0.05 g |
| **Second layer: intermediate layer** | |
| Gelatin | 0.4 g |
| Compound Cpd-F | 0.050 g |
| Compound Cpd-R | 0.020 g |
| Compound Cpd-S | 0.020 g |
| High boiling point organic solvent Oil-6 | 0.010 g |
| High boiling point organic solvent Oil-7 | 5.0 mg |
| High boiling point organic solvent Oil-8 | 0.020 g |
| Dye D-11 | 2.0 mg |
| Dye D-7 | 4.0 mg |
| **Third layer: intermediate layer** | |
| Gelatin | 0.4 g |
| **Fourth layer: photosensitive emulsion layer** | |
| Emulsion N | 0.20 g (silver amount) |
| Emulsion O | 0.10 g (silver amount) |
| Fine grains of silver iodide (average equivalent-sphere diameter 0.05 μm, cube) | 0.050 g (silver amount) |
| Gelatin | 0.5 g |
| Compound Cpd-F | 0.030 g |
| High boiling point organic solvent Oil-6 | 0.010 g |
| **Fifth layer: photosensitive emulsion layer** | |
| Emulsion Q | 0.20 g (silver amount) |
| Gelatin | 0.4 g |
| **Sixth layer: intermediate layer** | |
| Gelatin | 1.50 g |
| Compound Cpd-M | 0.10 g |
| Compound Cpd-D | 0.010 g |
| Compound Cpd-K | 3.0 mg |
| Compound Cpd-O | 3.0 mg |
| Compound Cpd-T | 5.0 mg |

-continued

| | | |
|---|---|---|
| Ultraviolet absorbing agent U-6 | | 0.010 g |
| High boiling point organic solvent Oil-6 | | 0.10 g |
| High boiling point organic solvent Oil-3 | | 0.010 g |
| High boiling point organic solvent Oil-4 | | 0.010 g |
| Seventh layer: red light-sensitive emulsion layer having low sensitivity | | |
| Emulsion A | silver amount | 0.05 g |
| Emulsion B | silver amount | 0.10 g |
| Emulsion Em-14 | silver amount | 0.25 g |
| Yellow colloidal silver | silver amount | 1.0 mg |
| Gelatin | | 0.60 g |
| Coupler C-1 | | 0.15 g |
| Coupler C-2 | | 7.0 mg |
| Ultraviolet absorbing agent U-2 | | 3.0 mg |
| Compound Cpd-J | | 2.0 mg |
| High boiling point organic solvent Oil-5 | | 0.050 g |
| High boiling point organic solvent Oil-10 | | 0.020 g |
| Eighth layer: red light-sensitive emulsion layer having medium sensitivity | | |
| Emulsion Em-7 | | 0.20 g (silver amount) |
| Emulsion Em-14 | | 0.15 g (silver amount) |
| Silver bromide emulsion whose inside has been fogged (cube, average equivalent-sphere grain diameter 0.11 μm) | silver amount | 0.010 g (silver amount) |
| Gelatin | | 0.60 g |
| Coupler C-1 | | 0.15 g |
| Coupler C-2 | | 7.0 mg |
| High boiling point organic solvent Oil-5 | | 0.050 g |
| High boiling point organic solvent Oil-10 | | 0.020 g |
| Compound Cpd-T | | 2.0 mg |
| Ninth layer: red light-sensitive emulsion layer having high sensitivity | | |
| Emulsion Em-1 | | 0.35 g (silver amount) |
| Gelatin | | 1.50 g |
| Coupler-C-1 | | 0.70 g |
| Coupler-C-2 | | 0.025 g |
| Coupler-C-3 | | 0.020 g |
| Coupler-C-8 | | 3.0 mg |
| Ultraviolet absorbing agent U-1 | | 0.010 g |
| High boiling point organic solvent Oil-5 | | 0.25 g |
| High boiling point organic solvent Oil-9 | | 0.05 g |
| High boiling point organic solvent Oil-10 | | 0.10 g |
| Compound Cpd-D | | 3.0 mg |
| Compound Cpd-L | | 1.0 mg |
| Compound Cpd-T | | 0.050 g |
| Additive P-1 | | 0.010 g |
| Additive P-3 | | 0.010 g |
| Dye D-8 | | 1.0 mg |
| Tenth layer: intermediate layer | | |
| Gelatin | | 0.50 g |
| Additive P-2 | | 0.030 g |
| Dye D-5 | | 0.010 g |
| Dye D-9 | | 6.0 mg |
| Compound Cpd-I | | 0.020 g |
| Compound Cpd-O | | 3.0 mg |
| Compound Cpd-P | | 5.0 mg |
| Eleventh layer: intermediate layer | | |
| Yellow colloidal silver | | 3.0 mg (silver amount) |
| Gelatin | | 1.00 g |
| Additive P-2 | | 0.010 g |
| Compound Cpd-A | | 0.030 g |
| Compound Cpd-M | | 0.10 g |
| Compound Cpd-O | | 2.0 mg |
| Ultraviolet absorbing agent U-1 | | 0.010 g |
| Ultraviolet absorbing agent U-2 | | 0.010 g |
| Ultraviolet absorbing agent U-5 | | 5.0 mg |
| High boiling point organic solvent Oil-3 | | 0.010 g |
| High boiling point organic solvent Oil-6 | | 0.10 g |
| Twelfth layer: green light-sensitive emulsion layer having low sensitivity | | |
| Emulsion C | | 0.15 g (silver amount) |
| Emulsion D | | 0.15 g (silver amount) |
| Emulsion E | | 0.15 g (silver amount) |
| Gelatin | | 1.00 g |
| Coupler C-4 | | 0.060 g |
| Coupler C-5 | | 0.10 g |
| Compound Cpd-B | | 0.020 g |
| Compound Cpd-G | | 2.5 mg |

-continued

| | |
|---|---|
| Compound Cpd-K | 1.0 mg |
| High boiling point organic solvent Oil-2 | 0.010 g |
| High boiling point organic solvent Oil-5 | 0.020 g |

Thirteenth layer: green light-sensitive emulsion layer having medium sensitivity

| | |
|---|---|
| Emulsion E | 0.10 g (silver amount) |
| Emulsion F | 0.20 g (silver amount) |
| Gelatin | 0.50 g |
| Coupler C-4 | 0.10 g |
| Coupler C-5 | 0.050 g |
| Coupler C-6 | 0.010 g |
| Compound Cpd-B | 0.020 g |
| Compound Cpd-U | 8.0 mg |
| High boiling point organic solvent Oil-2 | 0.010 g |
| High boiling point organic solvent Oil-5 | 0.020 g |
| Additive P-1 | 0.010 g |

Fourteenth layer: green light-sensitive emulsion layer having high sensitivity

| | |
|---|---|
| Emulsion F | 0.15 g (silver amount) |
| Emulsion G | 0.25 g (silver amount) |
| Silver bromide emulsion whose inside has been fogged (cube, average equivalent-sphere grain diameter 0.11 μm) | 5.0 g (silver amount) |
| Gelatin | 1.20 g |
| Coupler C-4 | 0.50 g |
| Coupler C-5 | 0.20 g |
| Coupler C-7 | 0.10 g |
| Compound Cpd-B | 0.030 g |
| Compound Cpd-U | 0.020 g |
| High boiling point organic solvent Oil-5 | 0.15 g |
| Additive P-1 | 0.030 g |

Fifteenth layer: yellow filter layer

| | |
|---|---|
| Yellow colloidal silver | 2.0 g (silver amount) |
| Gelatin | 1.0 g |
| Compound Cpd-C | 0.010 g |
| Compound Cpd-M | 0.020 g |
| High boiling point organic solvent Oil-1 | 0.020 g |
| High boiling point organic solvent Oil-6 | 0.020 g |
| Fine crystal solid dispersion of dye E-2 | 0.25 g |

Sixteenth layer: photosensitive emulsion layer

| | |
|---|---|
| Emulsion P | 0.15 g (silver amount) |
| Gelatin | 0.40 g |
| Coupler C-1 | 5.0 mg |
| Coupler C-2 | 0.5 mg |
| High boiling point organic solvent Oil-5 | 2.0 mg |
| Compound Cpd-Q | 0.20 g |
| Dye D-6 | 2.0 mg |

Seventeenth layer: blue light-sensitive emulsion layer having low sensitivity

| | |
|---|---|
| Emulsion H | 0.10 g (silver amount) |
| Emulsion I | 0.10 g (silver amount) |
| Emulsion J | 0.10 g (silver amount) |
| Silver bromide emulsion whose surface and inside have been fogged (cube, average equivalent-sphere grain diameter 0.11 μm) | 0.010 g (silver amount) |
| Gelatin | 0.80 g |
| Coupler C-8 | 0.020 g |
| Coupler C-9 | 0.020 g |
| Coupler C-10 | 0.20 g |
| Compound Cpd-B | 0.010 g |
| Compound Cpd-I | 8.0 mg |
| Compound Cpd-K | 2.0 mg |
| Ultraviolet absorbing agent U-5 | 0.010 g |
| Additive P-1 | 0.020 g |

Eighteenth layer: blue light-sensitive emulsion layer having medium sensitivity

| | |
|---|---|
| Emulsion J | 0.20 g (silver amount) |
| Emulsion K | 0.20 g (silver amount) |
| Gelatin | 0.80 g |
| Coupler C-8 | 0.030 g |
| Coupler C-9 | 0.030 g |
| Coupler C-10 | 0.30 g |
| Compound Cpd-B | 0.015 g |
| Compound Cpd-E | 0.020 g |
| Compound Cpd-N | 2.0 mg |
| Compound Cpd-T | 0.010 g |
| Ultraviolet absorbing agent U-5 | 0.015 g |
| Additive P-1 | 0.030 g |

-continued

| | |
|---|---|
| Nineteenth layer: blue light-sensitive emulsion layer having high sensitivity | |
| Emulsion JL | 0.20 g (silver amount) |
| Emulsion M | 0.15 g (silver amount) |
| Gelatin | 2.00 g |
| Coupler C-8 | 0.10 g |
| Coupler C-9 | 0.15 g |
| Coupler C-10 | 1.10 g |
| Coupler C-3 | 0.010 g |
| High boiling point organic solvent Oil-5 | 0.020 g |
| Compound Cpd-B | 0.060 g |
| Compound Cpd-D | 3.0 mg |
| Compound Cpd-E | 0.020 g |
| Compound Cpd-F | 0.020 g |
| Compound Cpd-N | 5.0 mg |
| Compound Cpd-T | 0.070 g |
| Ultraviolet absorbing agent U-5 | 0.060 g |
| Additive P-1 | 0.10 g |
| Twentieth layer: first protective layer | |
| Gelatin | 0.70 g |
| Ultraviolet absorbing agent U-1 | 0.020 g |
| Ultraviolet absorbing agent U-5 | 0.030 g |
| Ultraviolet absorbing agent U-2 | 0.10 g |
| Compound Cpd-B | 0.030 g |
| Compound Cpd-O | 5.0 mg |
| Compound Cpd-A | 0.030 g |
| Compound Cpd-H | 0.20 g |
| Dye D-1 | 2.0 mg |
| Dye D-2 | 3.0 mg |
| Dye D-3 | 2.0 mg |
| High boiling point organic solvent Oil-2 | 0.020 g |
| High boiling point organic solvent Oil-3 | 0.030 g |
| Twenty-first layer: second protective layer | |
| Fine grain silver iodobromide grain-containing emulsion (average equivalent-circle diameter 0.06 μm, AgI content 1 mol %) | 0.10 g (silver amount) |
| Gelatin | 0.80 g |
| Ultraviolet absorbing agent U-2 | 0.030 g |
| Ultraviolet absorbing agent U-5 | 0.030 g |
| High boiling point organic solvent Oil-2 | 0.010 g |
| Twenty-second layer: third protective layer | |
| Gelatin | 1.00 g |
| Polymethyl methacrylate (average grain diameter 1.5 μm) | 0.10 g |
| Copolymer of methylmethacrylate and methacrylic acid by 6:4 (average grain diameter 1.5 μm) | 0.15 g |
| Silicone oil SO-1 | 0.20 g |
| Surfactant W-1 | 0.010 g |
| Surfactant W-2 | 0.040 g |

In addition to the aforementioned composition, additives F-1 to F-9 were added to all the emulsion layers. Further, to each of layers, a gelatin hardening agent H-1 and surfactants W-2, W-3 and W-4 for coating and emulsifying were added in addition to the aforementioned composition.

Furthermore, as an antiseptic agent and fungicide, phenol, 1,2-benzisothiazoline-3-one, 2-phenoxy ethanol, phenethyl alcohol and p-butyl benzoate were added.

The Example 101 thus prepared had a coating thickness of 24.0 μm in a dried state, and a swelling ratio of 1.78 folds when it was swollen with distilled water at 25° C. Next, Examples 102 to 119 were prepared by changing the emulsion Em-1 in the ninth layer, the emulsion Em-7 in the eighth layer and the emulsion Em-14 in the seventh and eighth layer used in the preparation of the Example 101 as listed in Table 4.

TABLE 1

Constitutution of silver halide emulsion

Silver ioddobromide emulsion used for sample 101

| Emulsion | Feature | Average equivalent-sphere grain diameter (μm) | Coefficient of variation (%) | Average silver iodide content (%) | Halogen composition structure of siver halide grain | Average silver iodide content of grain surface (%) | Other features (1) | (2) | (3) | (4) | (5) |
|---|---|---|---|---|---|---|---|---|---|---|---|
| A | monodispersion tetradecahedral grain | 0.18 | 10 | 3.5 | fourfold structure | 2.5 | ○ | ○ | | | ○ |

TABLE 1-continued

Constitutution of silver halide emulsion

Silver ioddobromide emulsion used for sample 101

| Emulsion | Feature | Average equivalent-sphere grain diameter (μm) | Coefficient of variation (%) | Average silver iodide content (%) | Halogen composition structure of siver halide grain | Average silver iodide content of grain surface (%) | Other features (1) | (2) | (3) | (4) | (5) |
|---|---|---|---|---|---|---|---|---|---|---|---|
| B | monodispersion (111) tabular grain average aspect ratio 3.0 | 0.20 | 10 | 2.5 | fourfold structure | 2.5 | | | ○ | ○ | |
| C | monodispersion cubic grain | 0.14 | 9 | 3.5 | fourfold structure | 0.3 | | | ○ | ○ | |
| D | monodispersion cubic grain | 0.22 | 12 | 1.9 | fourfold structure | 0.7 | ○ | ○ | | ○ | ○ |
| E | monodispersion (111) tabular grain average aspect ratio 4.0 | 0.35 | 12 | 3.5 | fivefold structure | 1.5 | ○ | ○ | | ○ | ○ |
| F | monodispersion (111) tabular grain average aspect ratio 7.0 | 0.40 | 21 | 2.0 | fourfold structure | 2.2 | ○ | ○ | | ○ | ○ |
| G | monodispersion (111) tabular grain average aspect ratio 8.5 | 0.65 | 13 | 1.7 | threefold structure | 1.3 | ○ | ○ | | | ○ |
| H | monodispersion tetradecahedral grain | 0.30 | 9 | 7.5 | threefold structure | 0.8 | | | ○ | | |
| I | monodispersion tetradecahedral grain | 0.30 | 9 | 7.5 | threefold structure | 2.5 | | ○ | | ○ | |
| J | monodispersion (111) tabular grain average aspect ratio 3.0 | 0.35 | 13 | 2.1 | fivefold structure | 4.0 | ○ | ○ | | | ○ |

TABLE 2

Copntinuation of Table 1

| | Average equivalent-sphere grain diameter (μm) | Coefficient of variation (%) | Average silver iodide content (%) | Halogen composition structure of silver halide grain | Average silver iodide content of grain surface (%) | Other features (1) | (2) | (3) | (4) | (5) |
|---|---|---|---|---|---|---|---|---|---|---|
| K Monodispersion (111) tabular grain average aspect ratio: 5.0 | 0.45 | 9 | 2.5 | Four-fold structure | 1.0 | ○ | ○ | | ○ | ○ |
| L Monodispersion (111) tabular grain average aspect ratio: 9.0 | 0.70 | 21 | 2.8 | Three-fold structure | 0.5 | ○ | ○ | | ○ | ○ |
| M Monodispersion (111) tabular grain average aspect ratio: 9.0 | 0.85 | 8 | 1.0 | Four-fold structure | 0.5 | ○ | ○ | | | ○ |
| N Monodispersion (111) tabular grain average aspect ratio: 5.0 | 0.40 | 15 | 8.0 | Four-fold structure | 4.0 | ○ | ○ | | | ○ |
| O Monodispersion (111) tabular grain average aspect ratio: 4.0 | 0.70 | 13 | 12.5 | Four-fold structure | 3.0 | | ○ | ○ | | ○ |
| P Monodispersion (111) tabular grain average aspect ratio: 4.0 | 0.45 | 13 | 10.5 | Four-fold structure | 2.8 | ○ | ○ | | | ○ |
| Q Monodispersion (111) tabular grain average aspect ratio: 4.0 | 0.55 | 15 | 12.5 | Three-fold structure | 1.5 | | ○ | ○ | | ○ |

Details of "Other features":
(1) A reducing sensitizer was added at forming the grain.
(2) A selenium sensitizer was used as a post-maturing chemical.
(3) A rhodium salt was added at forming the grain.
(4) After the post-maturing, silver nitrate and potassium bromide were added by 10% in terms of silver mol ratio, respectively, relative to grains in the emulsion at that time to provide a shell.
(5) Observation with a trasnmission electron microscope revealed existence of dislocation lines by 10 or more per 1 grain on an average.
All of the photosensitive emulsion were post-matured by using sodium thiosulfate, potassium thiocyanate and sodium chloroaurate. Further, an irridium salt was arbitrarily added at forming the grain. Furthermore, to emulsions C, D, E, H, I, J, K, L, M, N, and O,a chemically-modified gelatin in which a part of amino groups in gelatin had been converted to phthalic acid amide was added at forming the emulsion.

TABLE 3

Spectral sensitization of emulsions A to O

| Emulsion | Added sensitizing dye | Addition amount per 1 mol of silver halide (g) | Time of adding the sensitizing dye |
|---|---|---|---|
| A | S-1 | 0.82 | after post-maturing |
| | S-2 | 0.08 | " |
| | S-3 | 0.10 | " |
| B | S-1 | 0.75 | before post-maturing |
| | S-2 | 0.15 | " |
| | S-3 | 0.05 | " |
| C | S-4 | 0.65 | after post-maturing |
| | S-5 | 0.10 | " |
| D | S-4 | 0.60 | after post-maturing |
| | S-5 | 0.10 | " |
| E | S-4 | 0.70 | before post-maturing |
| | S-5 | 0.10 | " |
| F | S-4 | 0.80 | before post-maturing |
| | S-5 | 0.10 | " |
| G | S-4 | 0.80 | before post-maturing |
| | S-5 | 0.15 | " |
| H, I | S-6 | 0.10 | after post-maturing |
| | S-7 | 0.10 | " |
| | S-8 | 0.50 | " |

TABLE 3-continued

Spectral sensitization of emulsions A to O

| Emulsion | Added sensitizing dye | Addition amount per 1 mol of silver halide (g) | Time of adding the sensitizing dye |
|---|---|---|---|
| J | S-6 | 0.10 | after post-maturing |
| | S-7 | 0.20 | " |
| | S-8 | 0.65 | " |
| K | S-6 | 0.06 | after post-maturing |
| | S-7 | 0.15 | " |
| | S-8 | 0.70 | " |
| L | S-6 | 0.05 | before post-maturing |
| | S-7 | 0.15 | " |
| | S-8 | 0.80 | " |
| M | S-4 | 0.40 | after post-maturing |
| | S-6 | 0.30 | " |
| N | S-4 | 0.40 | after post-maturing |
| | S-6 | 0.30 | " |
| O | S-7 | 0.05 | before post-maturing |
| P | S-8 | 0.60 | " |
| | S-1 | 0.60 | before post-maturing |
| | S-3 | 0.30 | " |

TABLE 4

List of emulsions used for preparing samples 101 to 119

| | Seventh and eighth layers | | | | An eighth layer | | | | A ninth layer | | | | |
|---|---|---|---|---|---|---|---|---|---|---|---|---|---|
| Sample | Emulsion | Dislocation line | Internal latent image | Epitaxial (to host silver amount/%) | Emulsion | Dislocation line | Internal latent image | Epitaxial (to host silver amount/%) | Emulsion | Dislocation line | Internal latent image | Epitaxial (to host silver amount/%) | |
| 101 | Em-14 | ○ | X | X | Em-7 | ○ | X | X | Em-1 | ○ | X | X | Comparative Example |
| 102 | Em-14 | ○ | X | X | Em-7 | ○ | X | X | Em-2 | ○ | X | X | Comparative Example |
| 103 | Em-14 | ○ | X | X | Em-7 | ○ | X | X | Em-3 | X | X | X | Comparative Example |
| 104 | Em-14 | ○ | X | X | Em-7 | ○ | X | X | Em-4 | X | ○ | X | Comparative Example |
| 105 | Em-14 | ○ | X | X | Em-7 | ○ | X | X | Em-5 | X | Δ | ○ (4.4) | Comparative Example |
| 106 | Em-14 | ○ | X | X | Em-7 | ○ | X | X | Em-6 | X | X | ○ (2.0) | Comparative Example |
| 107 | Em-14 | ○ | X | X | Em-8 | ○ | X | X | Em-2 | ○ | X | X | Comparative Example |
| 108 | Em-14 | ○ | X | X | Em-9 | X | X | X | Em-2 | ○ | X | X | Comparative Example |
| 109 | Em-14 | ○ | X | X | Em-10 | X | ○ | X | Em-2 | ○ | X | X | Comparative Example |
| 110 | Em-14 | ○ | X | X | Em-11 | X | Δ | ○ (4.4) | Em-2 | ○ | X | X | Comparative Example |
| 111 | Em-14 | ○ | X | X | Em-12 | X | X | ○ (2.0) | Em-2 | ○ | X | X | Comparative Example |
| 112 | Em-14 | ○ | X | X | Em-13 | X | Δ | ○ (14.0) | Em-2 | ○ | X | X | Comparative Example |

TABLE 4-continued

List of emulsions used for preparing samples 101 to 119

| | Seventh and eighth layers | | | | An eighth layer | | | | A ninth layer | | | | |
|---|---|---|---|---|---|---|---|---|---|---|---|---|---|
| Sample | Emulsion | Dislocation line | Internal latent image | Epitaxial (to host silver amount/%) | Emulsion | Dislocation line | Internal latent image | Epitaxial (to host silver amount/%) | Emulsion | Dislocation line | Internal latent image | Epitaxial (to host silver amount/%) | |
| 113 | Em-15 | ○ | X | X | Em-13 | X | Δ | ○ (14.0) | Em-2 | ○ | X | X | Comparative Example |
| 114 | Em-16 | X | X | X | Em-13 | X | Δ | ○ (14.0) | Em-2 | ○ | X | X | Comparative Example |
| 115 | Em-17 | X | ○ | X | Em-13 | X | Δ | ○ (14.0) | Em-2 | ○ | X | X | Comparative Example |
| 116 | Em-18 | X | Δ | ○ (4.4) | Em-13 | X | Δ | ○ (14.0) | Em-2 | ○ | X | X | Present Invention |
| 117 | Em-19 | X | X | ○ (2.0) | Em-13 | X | Δ | ○ (14.0) | Em-2 | ○ | X | X | Present Invention |
| 118 | Em-20 | X | Δ | ○ (10.0) | Em-13 | X | Δ | ○ (14.0) | Em-2 | ○ | X | X | Present Invention |
| 119 | Em-21 | Δ | Δ | ○ (4.4) | Em-13 | X | Δ | ○ (14.0) | Em-2 | ○ | X | X | Present Invention |

○: requirement is attained sufficiently
Δ: requirement is attained slightly
X: requirement is not attained

C-1

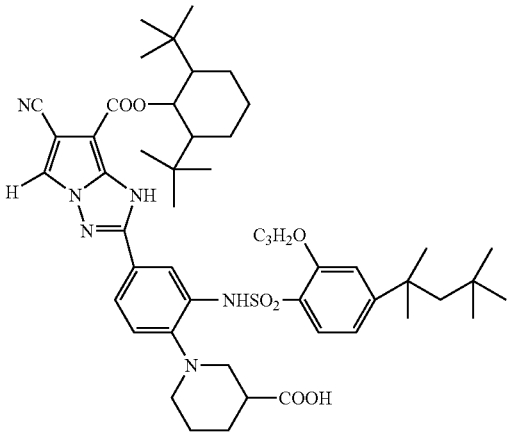

C-2

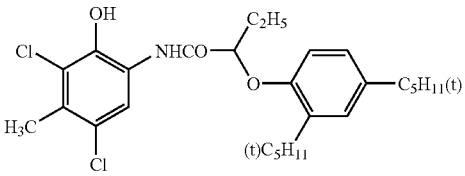

C-3

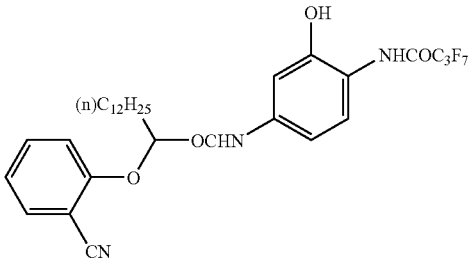

C-4

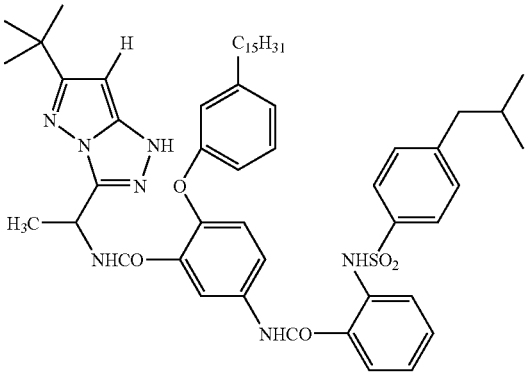

-continued
C-5
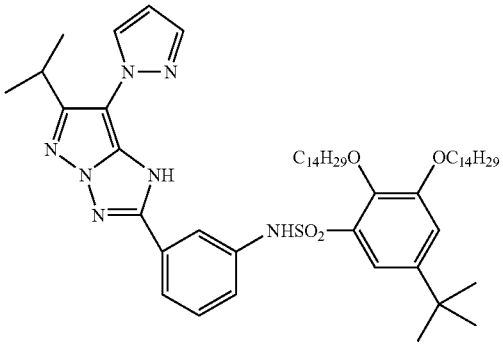
C-6
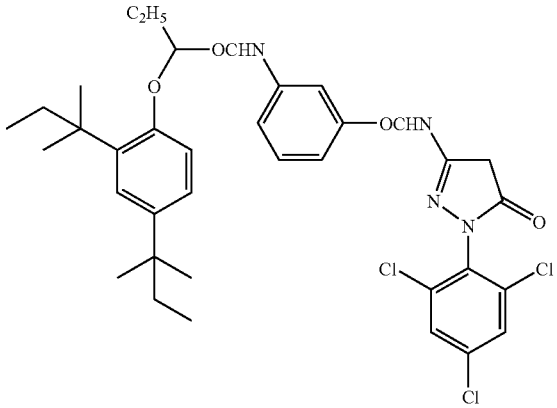
C-7
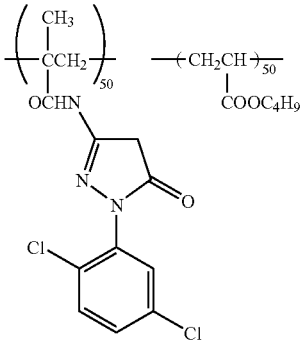
(Numerals means % by mass of each unit.)
Average molecular weight: about 25,000
C-8
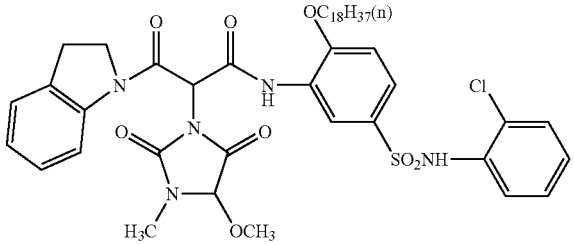
C-9
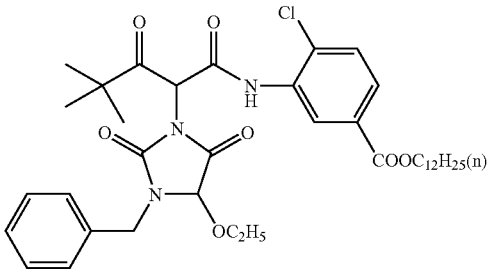
C-10
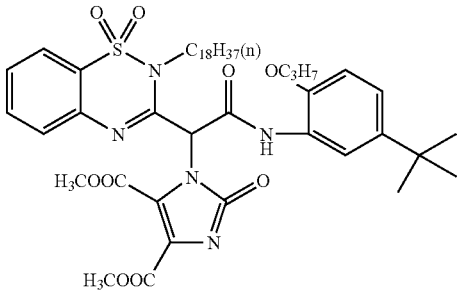
Oil-1
Tri-n-hexyl phosphate
Oil-2
Tricresyl phosphate
Oil-3
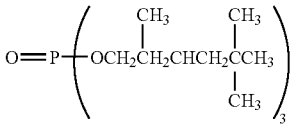
Oil-4
Tricyclohexyl phosphate
Oil-5
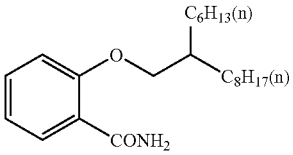
Oil-6
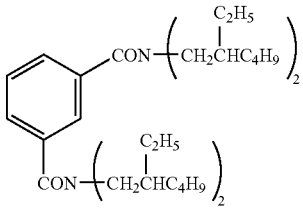

-continued
Oil-7
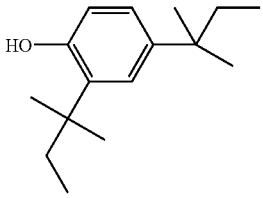
Oil-8
Mixture of isomers of
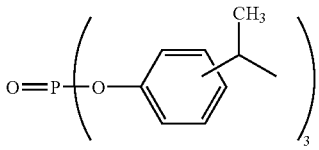
Oil-9
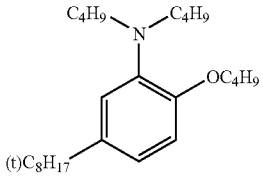
Oil-10
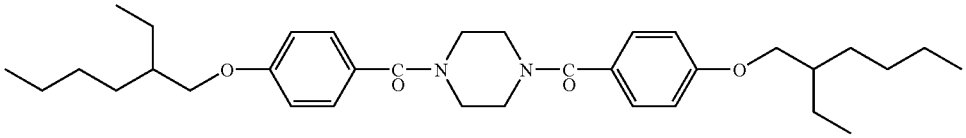
Cpd-A
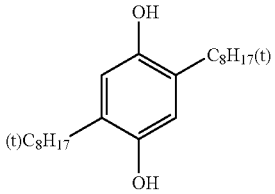
Cpd-B
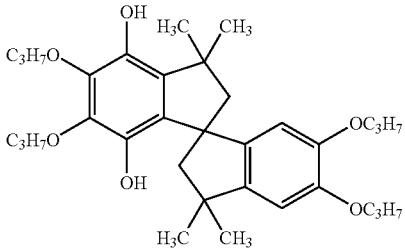
Cpd-C
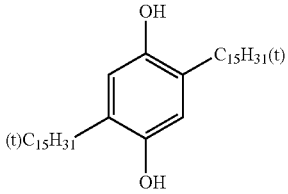
Cpd-D
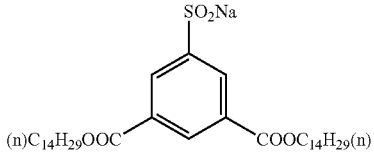
Cpd-E
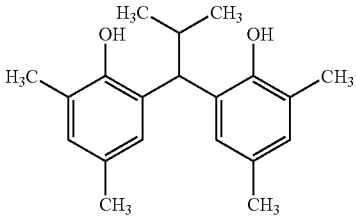
Cpd-F
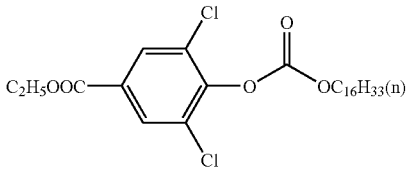
Cpd-G
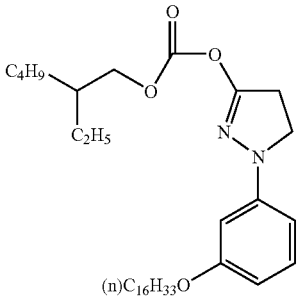
Cpd-H
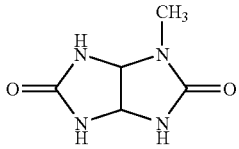

-continued
Cpd-I
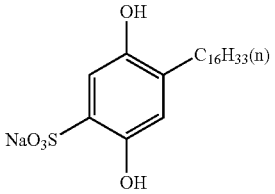
Cpd-J
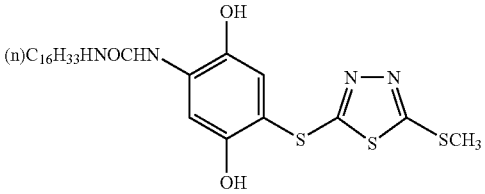
Cpd-K
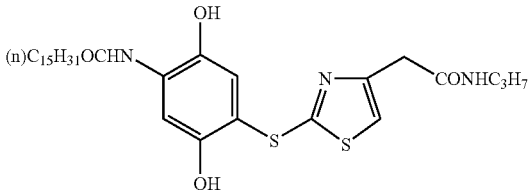
Cpd-L
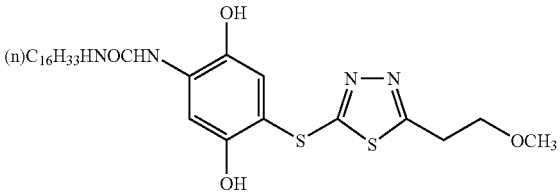
Cpd-M
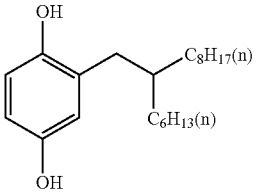
Cpd-N
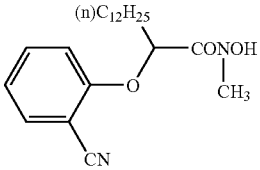
Cpd-O
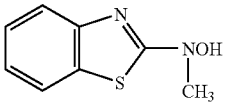
Cpd-P
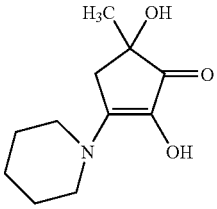
Cpd-Q
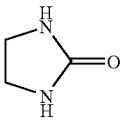
Cpd-R
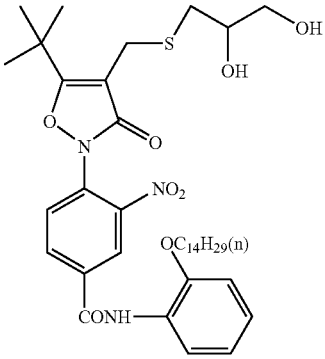
Cpd-S
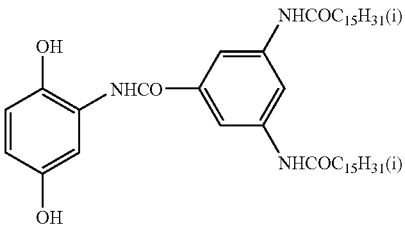
Cpd-T
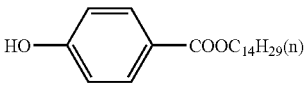

-continued
Cpd-U
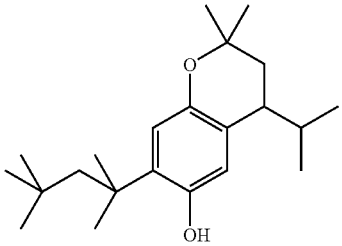
U-1
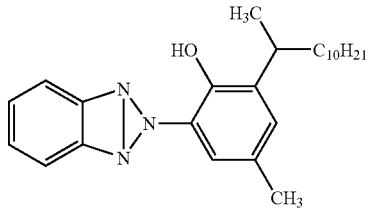
U-2
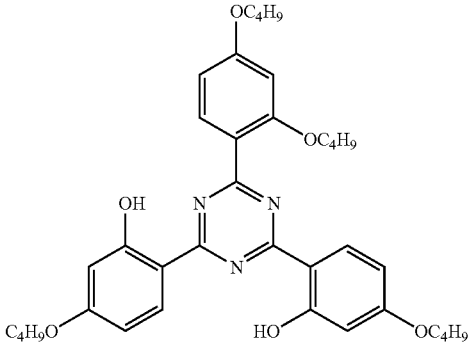
U-3
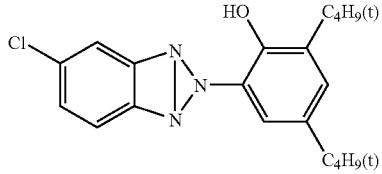
U-4
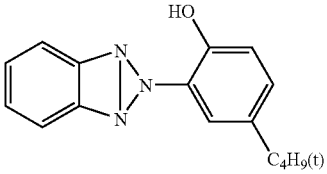
U-5
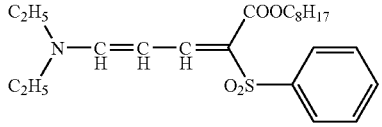
U-6
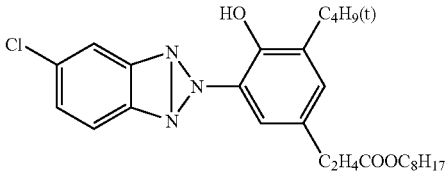
S-1
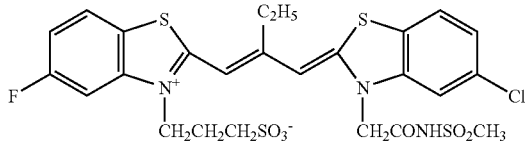
S-2
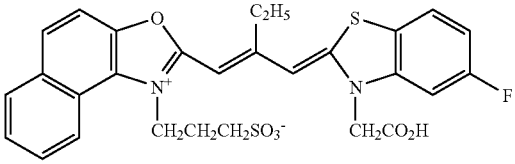
S-3
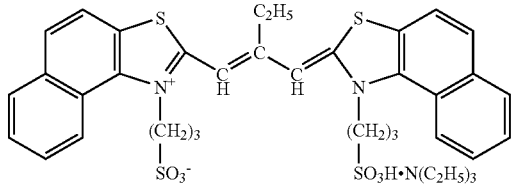
S-4
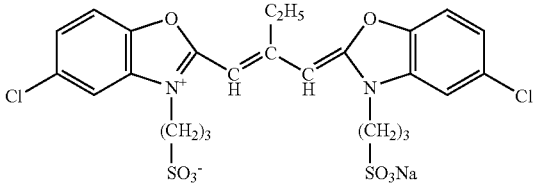
S-5
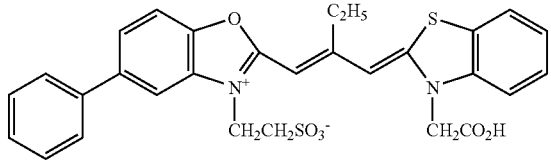
S-6
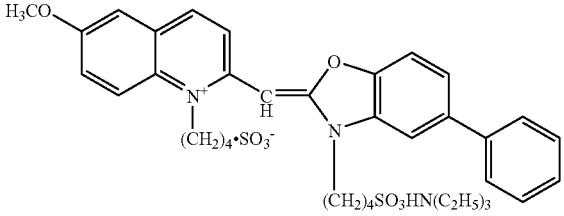

-continued
S-7
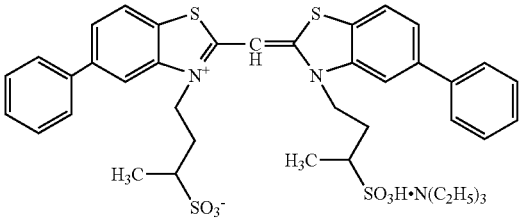
S-8
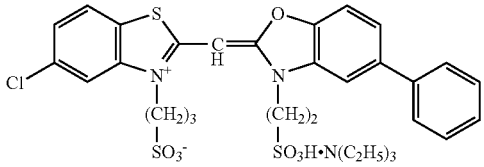
D-1
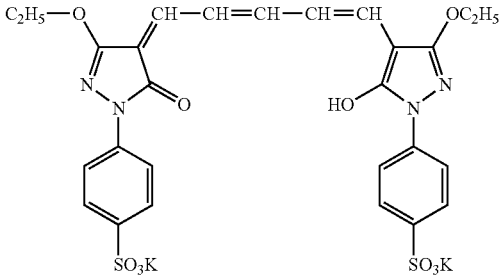
D-2
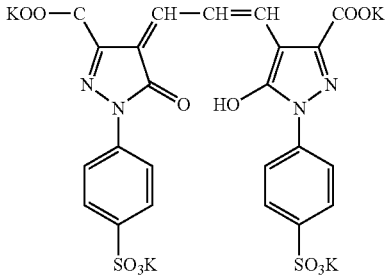
D-3
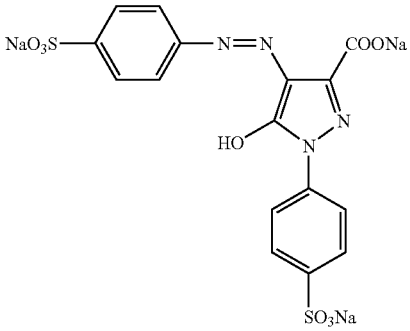
D-4
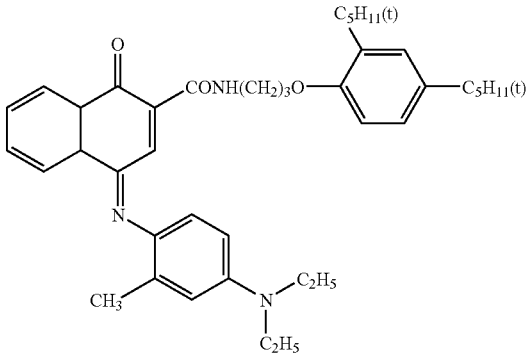
D-5
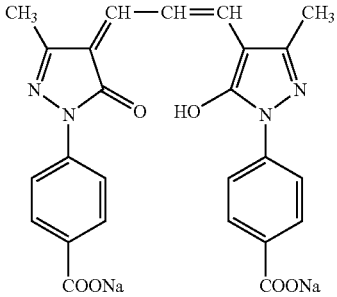
D-6
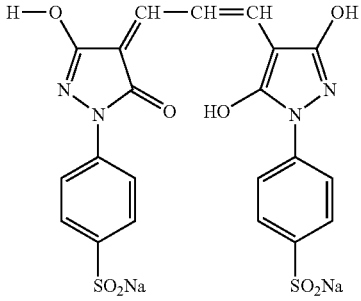
D-7
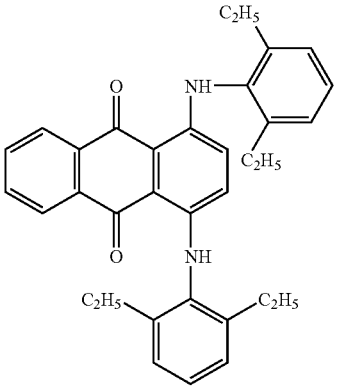

-continued
D-8
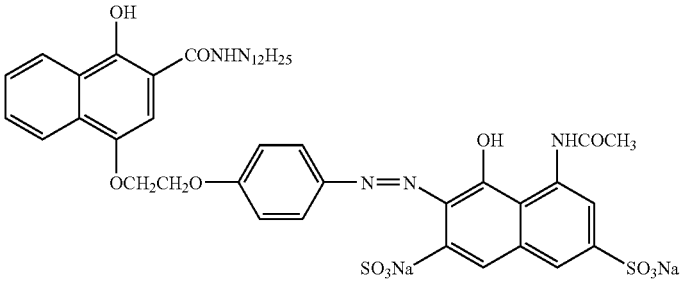
D-9
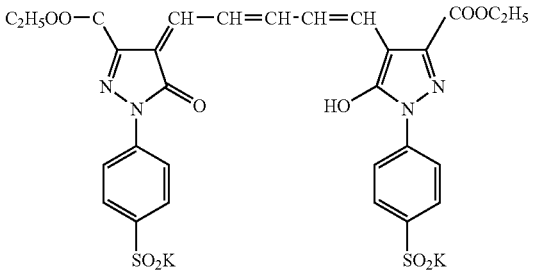
D-10
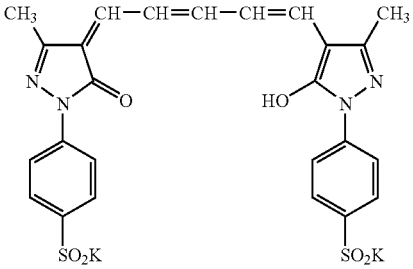
D-11
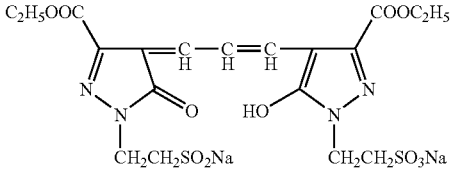
E-1
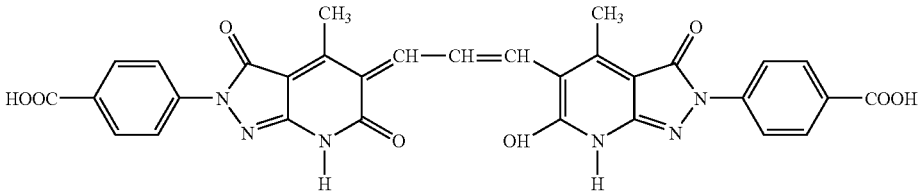
E-2
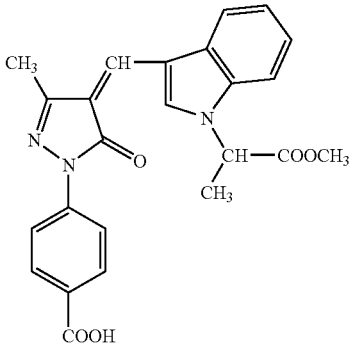
H-1
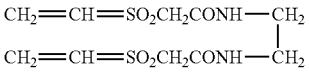
W-1
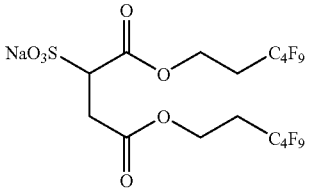
W-2
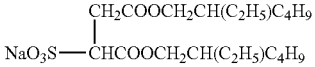

-continued
W-3
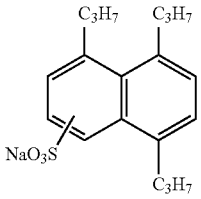
(60:40) Mixture of
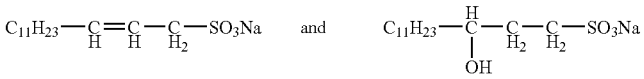
W-4
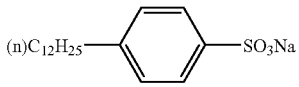
W-5
P-1
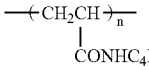
(n = 100~1000)
P-2
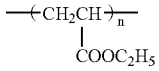
(n = 100~1000)
P-3
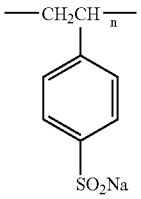
(n = 100~1000)
P-4
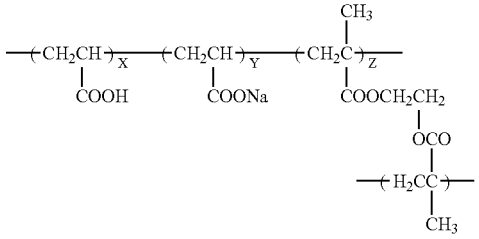
(X: Y: Z = 42.5:7.5:50)
F-1
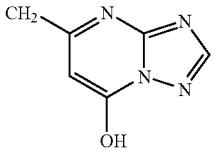
F-2
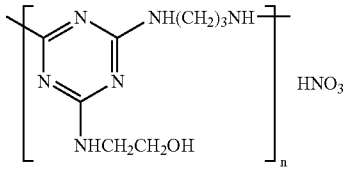
n = 3~4
F-3
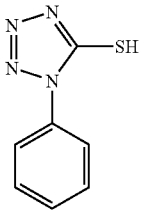
F-4
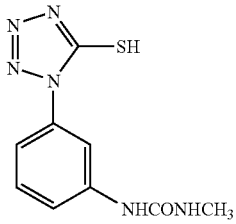
F-5
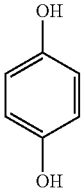
F-6
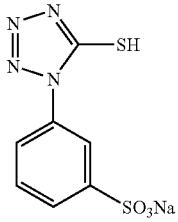
F-7
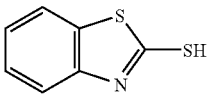
F-8
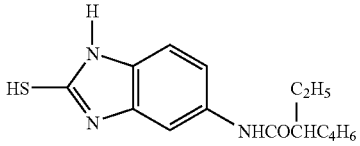

-continued

F-9

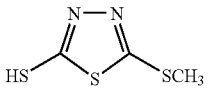

SO-1

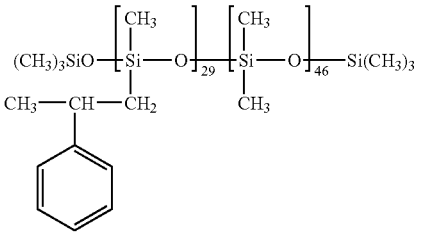

Preparation of Organic Solid Dispersant Dye

Preparation of a Dispersion of Dye E-1

A wet cake of dye E-1 (270 g as a net-weight of E-1) was added with 15 g of W-5 and water and stirred to give 4000 g of a slurry. Next, an ultra viscomill (tradename: UVM-2, manufactured by Imex Co.) was charged with 1700 mL of zirconia beads having an average grain diameter of 0.5 mm, through which the slurry was passed and crushed at a peripheral velocity of about 10 m/sec and discharge volume of 0.5 L/min over 2 hours. After beads were removed by filtration, water was added to dilute to dye concentration of 3%, then the liquid was heated at 90° C. for 10 hours for stabilization. Obtained fine grains of the dye have an average grain diameter of 0.25 μm and a width of the grain diameter distribution (grain diameter standard deviation×100/average grain diameter) was 20%.

Preparation of a Solid Dispersion of the Dye E-2

1400 g of a wet cake of E-2 containing 30% by mass of water was added with water and 270 g of W-3 and stirred to provide a slurry of E-2 having a concentration of 40% by mass. Next, a crusher which is called an ultra viscomill (tradename: UVM-2, mamfactured by Imex Co.) was charged with 1700 mL of zirconia beads having an average grain diameter of 0.5 mm, through which the slurry was passed and crushed at a peripheral velocity of about 10 m/sec and discharge volume of 0.5 L/min over 8 hours to provide a solid fine grain dispersion of E-2. The dispersion was diluted to 20% by mass by adding ion-exchanged water to provide a solid fine grain dispersion. The average grain size was 0.15 μm.

Examples thus prepared were evaluated as follows.

(1) Evaluation of Photographic Properties (Sensitivity and Fog)

Examples 101 to 119 were subjected to wedge exposure for 1/100 second and to color reversal development processing indicated below. With regard to the processing, processing for the evaluation was conducted after running-processing an Example 101 with no exposure and an Example 101 with full exposure by a ratio of 1:1 until a replenishment volume of the developer became four times that of the tank capacity. Photographic sensitivity was evaluated in terms of relative sensitivity, taking the sensitivity of the Example 101 as 100. Sensitivity of the highest sensitivity-emulsion layers were compared by relative comparison of reciprocal number of the exposure amount giving cyan density of 2.0; sensitivity of the medium sensitivity-emulsion layers were compared by relative comparison of reciprocal number of the exposure amount giving cyan density of 1.0; and sensitivity of the lowest sensitivity-emulsion layers were compared by relative comparison of reciprocal number of the exposure giving cyan density of 0.5. A larger numerical value means a higher sensitivity. Fog was evaluated based on variation from the highest density of the Example 101 which was defined as 0. A larger minus value means a higher fog.

(2) RMS Granularity Value

For the Examples 101 to 119 after processing, RMS granularity value was measured at cyan densities of 2.0, 1.0 and 0.5. Results were represented by relative values, taking RMS granularity value of the Example 101 as 100. The smaller the value, the finer the graininess.

(3) Latent Image Storability p Three Example groups each containing Examples 101 to 119 were prepared, which were subjected to wedge exposure at 1/100 second. One group was stored at 30% RH and 50° C. for 3 days; another group was stored at 80% RH and 50° C. for 3 days; and the remaining group was stored in a freezer to be a control. They were processed in the same way as described in (1), followed by conducting sensitometry to give sensitivity variations, which were compared. A value closest to 100 means a smaller performance change after storage, and indicating superiority in performance.

Processing procedures and processing liquids of standard development treatment

| Processing | Time (min) | Temperature | Tank capacity (L) | Replenishment volume (L/m$^2$) |
|---|---|---|---|---|
| First development | 6 | 38° C. | 37 | 2200 |
| First washing | 2 | 38° C. | 16 | 4000 |
| Reversal | 2 | 38° C. | 17 | 1100 |
| Color development | 6 | 38° C. | 30 | 2200 |
| Pre-bleaching | 2 | 38° C. | 19 | 1100 |
| Bleaching | 6 | 38° C. | 30 | 220 |
| Fixing | 4 | 38° C. | 29 | 1100 |
| Second washing | 4 | 38° C. | 35 | 4000 |
| Final rinsing | 1 | 25° C. | 19 | 1100 |

Composition of respective processing liquids were as follows.

| First developer | [Tank liquid] | [Replenisher] |
|---|---|---|
| Nitrilo-N,N,N-trimethylene phosphonic acid.5 sodium salt | 1.5 g | 1.5 g |
| Diethylenetriamine pentaacetic acid.5 sodium salt | 2.0 g | 2.0 g |
| Sodium sulfite | 30 g | 30 g |
| Hydroquinone-potassium monosulfonate | 20 g | 20 g |

-continued

First developer

| | [Tank liquid] | [Replenisher] |
|---|---|---|
| Potassium carbonate | 15 g | 20 g |
| Potassium bicarbonate | 12 g | 15 g |
| 1-phenyl-4-methyl-4-hydroxymethyl-3-pyrazolidon | 2.5 g | 3.0 g |
| | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Adding water to give | 1000 mL | 1000 mL |
| pH | 9.60 | 9.60 |

pH was adjusted by using sulfuric acid or potassium hydroxide.

Reversal liquid

| | [Tank liquid] | [Replenisher] |
|---|---|---|
| Nitrilo-N,N,N-trimethylene phosphonic acid.5 sodium salt | 3.0 g | same as tank liquid |
| Stannous chloride.dihydrate | 1.0 g | " |
| p-amino phenol | 0.1 g | " |
| Sodium hydroxide | 8 g | " |
| Glacial acetic acid | 15 mL | " |
| Adding water to give | 1000 mL | " |
| pH | 6.00 | " |

pH was adjusted by using acetic acid or sodium hydroxide.

Color developer

| | [Tank liqui] | [Replenisher] |
|---|---|---|
| Nitrilo-N,N,N-trimethylene phosphonic acid.5 sodium salt | 2.0 g | 2.0 g |
| Sodium sulfite | 7.0 g | 7.0 g |
| Trisodium phosphate.dodecahydrate | 36 g | 36 g |
| Potassium bromide | 1.0 g | — |
| Potassium bromide | 90 mg | — |
| Sodium hydroxide | 12.0 g | 12.0 g |
| Citrazinic acid | 0.5 g | 0.5 g |
| N-ethyl-N-(β-methanesulfonamidoethyl)-3-methyl-4-aminoaniline.3/2 Sulfuric Acid.monohydrate | 10 g | 10 g |
| 3,6-dithiaoctane-1,8-diol | 1.0 g | 1.0 g |
| Adding water to give | 1000 mL | 1000 mL |
| pH | 11.80 | 12.00 |

pH was adjusted by using sulfuric acid or potassium hydroxide.

Pre-bleaching liquid

| | [Tank liquid] | [Replenisher] |
|---|---|---|
| Ethylenediamine tetraacetic acid.disodium salt.dihydrate Sodium sulfite | 6.0 g | 8.0 g |
| 1-thioglycerol | 0.4 g | 0.4 g |
| Formaldehyde sodium bisulfite addition product | 30 g | 35 g |
| Adding water to give | 1000 mL | 1000 mL |
| pH | 6.30 | 6.10 |

pH was adjusted by using acetic acid or sodium hydroxide.

| Bleaching liquid | [Tank liquid] | [Replenisher] |
|---|---|---|
| Ethylenediamine tetraacetic acid.disodium salt.dihydrate | 2.0 g | 4.0 g |
| Ethylenediamine tetraacetic acid.Fe(III).ammonium.dihydrate | 120 g | 240 g |
| Potassium bromide | 100 g | 200 g |
| Ammonium nitrate | 10 g | 20 g |
| Adding water to give | 1000 mL | 1000 mL |
| pH | 5.70 | 5.50 |

pH was adjusted by using nitric acid or sodium hydroxide.

| Fixing liquid | [Tank liquid] | [Replenisher] |
|---|---|---|
| Ammonium thiosulfate | 80 g | same as tank liquid |
| Sodium sulfite | 5.0 g | " |
| Sodium bisulfite | 5.0 g | " |
| Adding water to give | 1000 ml | " |
| pH | 6.60 | " |

pH was adjusted by using acetic acid or aqueous ammonia.

| Stabilizing liquid | Tank liquid | Replenisher |
|---|---|---|
| 1,2-benzoisothiazoline-3-one | 0.02 g | 0.03 g |
| Polyoxyethylene-p-monononylphenyl ether (average polymerization degree: 10) | 0.3 g | 0.3 g |
| Polymaleic acid (average molecular weight 2,000) | 0.1 g | 0.15 g |
| Adding water to give | 1000 mL | 1000 mL |
| pH | 7.0 | 7.0 |

In the development processing step, the liquid of each bath was continuously circulated and stirred and, further, a foaming tube provided with a small openings of 0.3 mm in diameter at intervals of 1 cm was disposed on underside of the tank, from which nitrogen gas was bubbled into the bath for continuous stirring.

After the development processing, density was measured by using a red filter to calculate a sensitivity (a reciprocal number of the exposure amount giving cyan density of 0.5) and fog (the lower maximum cyan density means a higher fog) of the seventh layer (the low sensitivity red light-sensitive layer); a sensitivity (a reciprocal number of the exposure amount giving cyan density of 1.0) and fog of the eighth layer: (the medium sensitivity red light-sensitive layer; and a sensitivity (a reciprocal number of the exposure amount giving cyan density of 2.0) and a fog of the ninth layer (the high sensitivity red light-sensitive layer). Further, in the same manner as described in Sample 1, cyan sensitivity of respective emulsion layers after storage with exposure to evaluate latent image storability.

The evaluation result is listed in Table 5.

TABLE 5

Evaluation result for Examples 101 to 119 (101–115: Comparative example; 116–119: The invention)

| | Density 0.5 | | | | Density 1.0 | | | | Density 2.0 | | | |
|---|---|---|---|---|---|---|---|---|---|---|---|---|
| | | RMS | Latent image storability | | | RMS | Latent image storability | | | RMS | Latent image storability | |
| | Sensitivity S0.5 | granularity RMS0.5 | 50° C. 30% RH | 50° C. 80% RH | Sensitivity S1.0 | granularity RMS1.0 | 50° C. 30% RH | 50° C. 80% RH | Sensitivity S2.0 | granularity RMS2.0 | 50° C. 30% RH | 50° C. 80% RH |
| 101 | 100 | 100 | 80 | 71 | 100 | 100 | 79 | 70 | 100 | 100 | 77 | 68 |
| 102 | 94 | 99 | 82 | 72 | 97 | 98 | 78 | 69 | 142 | 101 | 78 | 69 |
| 103 | 60 | 160 | 81 | 72 | 65 | 153 | 79 | 69 | 46 | 120 | 67 | 57 |
| 104 | 83 | 141 | 79 | 69 | 80 | 131 | 79 | 70 | 107 | 102 | 82 | 73 |
| 105 | 95 | 120 | 80 | 70 | 95 | 118 | 80 | 71 | 125 | 101 | 86 | 76 |
| 106 | 91 | 118 | 82 | 73 | 91 | 113 | 77 | 67 | 122 | 101 | 84 | 75 |
| 107 | 90 | 99 | 81 | 71 | 117 | 101 | 79 | 70 | 140 | 99 | 79 | 69 |
| 108 | 74 | 115 | 82 | 71 | 51 | 119 | 72 | 63 | 143 | 101 | 80 | 71 |
| 109 | 90 | 108 | 80 | 70 | 122 | 103 | 82 | 72 | 142 | 100 | 79 | 70 |
| 110 | 85 | 99 | 80 | 69 | 131 | 100 | 86 | 77 | 142 | 101 | 77 | 68 |
| 111 | 87 | 100 | 82 | 71 | 128 | 99 | 84 | 75 | 143 | 101 | 79 | 69 |
| 112 | 84 | 98 | 81 | 72 | 133 | 102 | 87 | 78 | 142 | 101 | 78 | 69 |
| 113 | 120 | 100 | 83 | 74 | 137 | 102 | 86 | 77 | 140 | 102 | 80 | 71 |
| 114 | 45 | 119 | 71 | 63 | 110 | 101 | 78 | 70 | 143 | 101 | 78 | 69 |
| 115 | 113 | 105 | 80 | 71 | 134 | 102 | 83 | 74 | 141 | 100 | 79 | 70 |
| 116 | 140 | 100 | 85 | 76 | 142 | 101 | 87 | 78 | 143 | 99 | 80 | 71 |
| 117 | 138 | 101 | 84 | 75 | 140 | 101 | 86 | 77 | 142 | 102 | 80 | 70 |
| 118 | 143 | 99 | 86 | 77 | 143 | 101 | 87 | 78 | 142 | 101 | 79 | 69 |
| 119 | 135 | 99 | 84 | 75 | 138 | 100 | 86 | 77 | 142 | 101 | 79 | 69 |

S0.5: Sensitivyty at density of 0.5
S1.0: Sensitivyty at density of 1.0
S2.0: Sensitivyty at density of 2.0
RMS0.5: RMS at density of 0.5
RMS1.0: RMS at density of 1.0
RMS2.0: RMS at density of 2.0
Notes:
Sensitivity is represented by a relative value while defining the sensitivity of Example 101 as 100. The higher the value is, the higher it is in sensitivity.
RMS granularity is represented by a relative value while defining the RMS granularity of Example 101 as 100. The higher the value is, the better it is in granularity.
Latent image storability is represented by a relative value while defining the sensitivity of the freezer-stored example as 100. The nearer the value is to 100, the lesser in sensitivity reduction and thus the better in storability.

From the result obtained for Examples 101 to 119, it can be seen that, in the multi-layer color photographic photosensitive material such as the Examples, the constitution of the invention in which the high sensitivity-emulsion layer contains an emulsion including the tabular grain having dislocation lines and the other emulsion layers contain the epitaxial emulsion that satisfies the requirement of the invention is the best in relation to sensitivity/graininess. And, as a more surprising result, it can be seen that the aforementioned constitution of the invention enables to manufacture a photographic photosensitive material also excellent in latent image storability.

What is claimed is:

1. A silver halide color photographic photosensitive material comprising:

a blue light-sensitive emulsion layer unit containing a yellow-forming color coupler;

a green light-sensitive emulsion layer unit containing a magenta-forming color coupler; and a red light-sensitive emulsion layer unit containing a cyan-forming color coupler on a support, wherein each of the blue light-sensitive emulsion layer unit, the green light-sensitive emulsion layer unit, and the red light-sensitive emulsion layer unit comprises at least two photosensitive emulsion layers having sensitivities which are different from each other;

an emulsion layer of the highest sensitivity among the at least two photosensitive emulsion layers comprises at least one silver halide emulsion in which tabular silver halide grains having an average aspect ratio of 3 or more and substantially having dislocation lines account for 50% or more of the total projected areas; and each of photosensitive emulsion layers other than the emulsion layer of the highest sensitivity consists of a silver halide emulsion containing silver halide grains that account for 70% or more of the total projected areas and satisfy a requirement (a): the grain is constituted of a tabular silver halide host grain having two principal planes parallel to each other and an aspect ratio of 2 or more, and of a protrusion of silver halide epitaxially joined to the host grain surface.

2. The silver halide color photographic photosensitive material of claim 1, wherein the silver halide grain satisfying the requirement (a) further satisfies a requirement (b): each of silver bromide content of the host grain and that of the protrusion is 70 mol %, or more.

3. The silver halide color photographic photosensitive material of claim 1, wherein the silver halide grain satisfying the requirement (a) further satisfies a requirement (c): a silver amount contained in the protrusion is at a ratio of 20% or less relative to a silver amount contained in the tabular silver halide.

4. The silver halide color photographic photosensitive material of claim 1, wherein the silver halide grain satisfying the requirement (a) further satisfies a requirement (d): the protrusion contains pseudo-halide.

5. The silver halide color photographic photosensitive material of claim 1, wherein the silver halide grain satisfying the requirement (a) further satisfies a requirement (e): the grain includes a hole trap zone.

6. The silver halide color photographic photosensitive material of claim 1, wherein the silver halide grain satisfying the requirement (a) further satisfies a requirement (f): an aspect ratio of the host grain is 10 or more.

7. The silver halide color photographic photosensitive material of claim 1, wherein the silver halide emulsion containing the silver halide grain satisfying the requirement (a) further satisfies a requirement (g): total development sensitivity of the emulsion is higher than surface development sensitivity thereof.

8. The silver halide color photographic photosensitive material of claim 1, the material comprising a compound represented by the following Formula (A):

Formula (A)

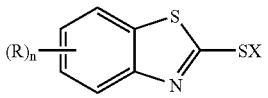

wherein X represents a hydrogen or an alkali metal atom; R represents a hydrogen, a halogen or an alkyl group having from 1 to 5 carbon atoms; and n represents an integer of 1 to 4.

9. The silver halide color photographic photosensitive material of claim 1, wherein at least one photosensitive emulsion that is included in at least one of the photosensitive emulsion layers further contains calcium.

10. The silver halide color photographic photosensitive material of claim 1, wherein the silver halide grain satisfying the requirement (a) further satisfies a requirement (h): the grain includes a temporary electron trap zone.

11. The silver halide color photographic photosensitive material of claim 1, wherein the silver halide grain satisfying the requirement (a) further satisfies a requirement (i): the grain is subjected to chemical sensitization after epitaxial formation.

12. The silver halide color photographic photosensitive material of claim 1, wherein all the photosensitive tabular grain emulsions other than the silver halide emulsion in which the tabular silver halide grains substantially including dislocation lines and having an average aspect ratio of 3 or more account for 50% or more of the total projected areas, which is contained in the emulsion layer of the highest sensitivity, are the silver halide emulsions containing the silver halide grain satisfying the requirement (a).

13. A silver halide color reversal photographic photosensitive material of claim 1, wherein the material is subjected to color reversal processing after exposure.

* * * * *